United States Patent [19]

Hirose et al.

[11] Patent Number: 5,057,871

[45] Date of Patent: Oct. 15, 1991

[54] DEVELOPING DEVICE HAVING A CONDUCTIVE POROUS TONER-REMOVING ROLLER

[75] Inventors: Kazunori Hirose, Hiratsuka; Yukio Nishio, Tama, both of Japan

[73] Assignee: Fujitsu Limited, Kawasaki, Japan

[21] Appl. No.: 493,260

[22] Filed: Mar. 14, 1990

[30] Foreign Application Priority Data

Mar. 16, 1989 [JP] Japan ..... 01-062001
Jul. 7, 1989 [JP] Japan ..... 01-176539

[51] Int. Cl.[5] ..... G03G 15/06

[52] U.S. Cl. ..... 355/259; 118/653; 355/253

[58] Field of Search ..... 355/245, 246, 259, 253; 118/661, 653, 656; 428/36.5, 319.1; 29/132

[56] References Cited

U.S. PATENT DOCUMENTS 4,227,797 10/1980 Tsunoi ..... 355/259
4,696,255 9/1987 Yano et al. ..... 118/653
4,745,429 5/1988 Mukai et al. ..... 118/656 X
4,755,847 7/1988 Matsushiro et al. ..... 355/259
4,760,422 7/1988 Seimiya et al. ..... 118/653 X
4,788,570 11/1988 Ogata et al. ..... 118/651 X

FOREIGN PATENT DOCUMENTS 53-138349 12/1978 Japan .
54-137346 10/1979 Japan .
55-77764 6/1980 Japan .
57-120947 7/1982 Japan .
60-6846 3/1985 Japan .
60-12627 4/1985 Japan .
61-43767 3/1986 Japan .
62-976 1/1987 Japan .
62-96981 5/1987 Japan .
62-118372 5/1987 Japan .
63-100482 5/1988 Japan .
63-189876 8/1988 Japan .
63-231469 9/1988 Japan .

*Primary Examiner*—A. T. Grimley
*Assistant Examiner*—Thu A. Dang
*Attorney, Agent, or Firm*—Armstrong, Nikaido, Marmelstein, Kubovcik & Murray

[57] ABSTRACT

A developing device using a one-component developer composed of colored fine synthetic resin toner particles, which device includes a vessel for holding the developer, and a developing roller rotatably provided within the vessel, a portion of the roller being exposed and resiliently pressed against a surface of an electrostatic latent image formation drum. The toner particles are held by the surface of the developing roller to form a developer layer around the surface, and are carried to the surface of the image formation drum for development of an electrostatic latent image formed on the drum surface. The developing device further includes a toner-removing roller rotatably provided within the vessel to be in contact with the developing roller for mechanically removing the remaining toner particles not used for the development of the image from the developing roller, and a blade or roller member provided within the vessel and resiliently engaged with the developing roller, for regulating a thickness of the developer layer formed around the developing roller. The toner-removing roller is formed of a conductive porous rubber material so that pore openings appear over a surface of the toner-removing roller, the pore openings having a diameter which is at most twice an average diameter of the toner particles, whereby a penetration of the toner particles into the toner-removing roller is prevented.

64 Claims, 18 Drawing Sheets

Fig.2
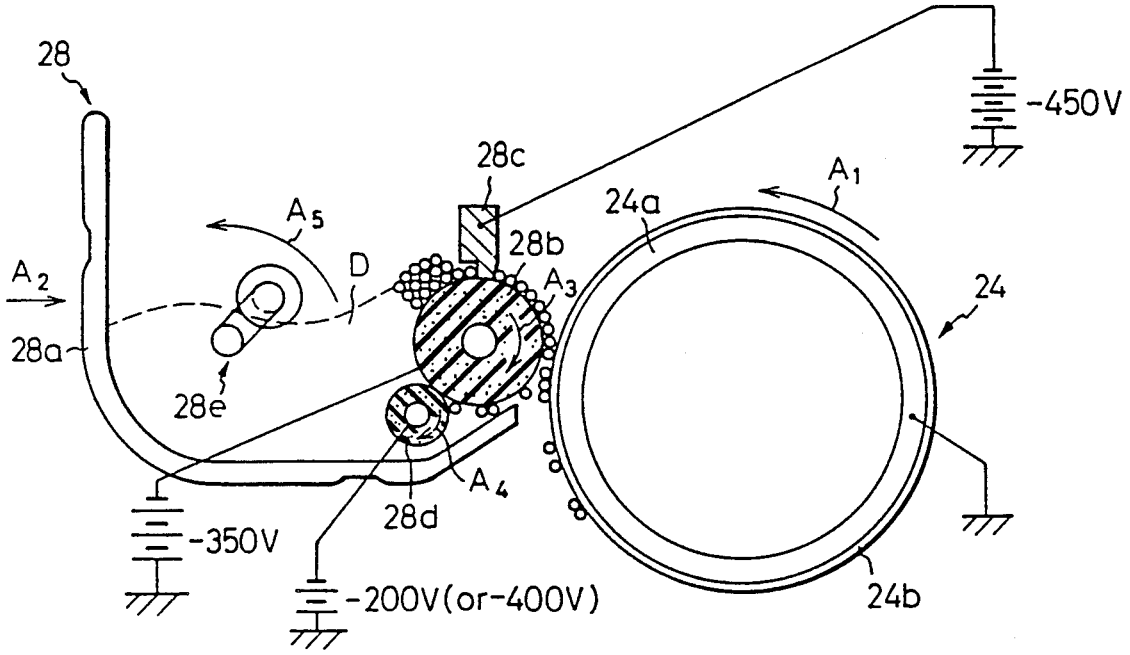
Fig.3
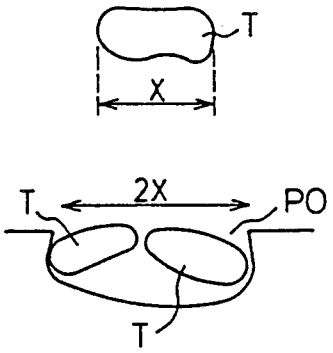
Fig.3(a)

DEVELOPING DEVICE HAVING A CONDUCTIVE POROUS TONER-REMOVING ROLLER

BACKGROUND OF THE INVENTION

1. Field of the Invention

The present invention relates to a developing device used in an electrophotographic field, wherein an electrostatic latent image is visually developed by using a non-magnetic one-component developer.

2. Description of the Related Art

As is well known, an electrophotographic printer carries out the processes of: producing a uniform distribution of electrical charges on a surface of an electrostatic latent image formation body; forming an electrostatic latent image on the electrically charged surface of the electrostatic latent image formation body by optically writing an image thereon by using a laser beam scanner, an LED (light emitting diode) array, a liquid crystal shutter array or the like; visually developing the electrostatic latent image with a developer, i.e., toner, which is electrically charged to be electrostatically adhered to the electrostatic latent image zone; electrostatically transferring the developed visible image to a paper; and fixing the transferred image on the paper. Typically, the electrostatic latent image formation body may be an electrophotographic photoreceptor, usually formed as a drum, called a photosensitive drum, having a cylindrical conductive substrate and a photoconductive insulating film bonded to a cylindrical surface thereof.

In the developing process, a two-component developer composed of a toner component (colored fine synthetic resin particles) and a magnetic component (magnetic fine carriers) is widely used, as it enables a stable development of the latent image. Note, typically the toner particles have an average diameter of about 10 μm, and the magnetic carriers have a diameter ten times larger than the average diameter of the toner particles. Usually, a developing device using the two-component developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller provided within the vessel as a developing roller in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the photosensitive drum for the development of the electrostatic latent image formed thereon. In this developing device, a ratio between the toner and magnetic components of the developer body held in the vessel must fall within a predetermined range, to continuously maintain a stable development process. Accordingly, the developing device is provided with a toner supplier from which a toner component is supplied to the two-component developer held in the vessel, to supplement the toner component as it is consumed during the development process, whereby the component ratio of the two-component developer held by the vessel is kept within the predetermined range. This use of a two-component developer is advantageous in that a stable development process is obtained thereby, but the developing device per se has the disadvantages of a cumbersome control of a suitable component ratio of the two-component developer, and an inability to reduce the size of the developing device due to the need to incorporate the toner supplier therein.

A one-component developer is also known in this field, and a developing device using same does not suffer from the above-mentioned disadvantages of the developing device using the two-component developer, because the one-component developer is composed of only a toner component (colored fine synthetic resin particles). Two types of the one-component developer are known; a magnetic type and a non-magnetic type. A developing device using the magnetic type one-component developer can be constructed in substantially the same manner as that using the two-component developer. Namely, the magnetic type one-component developer also can be brought to the surface of the photosensitive drum by a rotating magnetic roller as in the developing device using the two-component developer. The magnetic type one-component developer is suitable for achromatic color (black) printing, but is not suitable for chromatic color printing. This is because each of the toner particles of which the magnetic type one-component developer is composed includes fine magnetic powders having a dark color. In particular, the chromatic color printing obtained from the magnetic type one-component developer appears dark and dull, due to the fine magnetic powders included therein. Conversely, the non-magnetic type one-component developer is particularly suitable for chromatic color printing because it does not include a substance having a dark color, but the non-magnetic type one-component developer cannot be brought to the surface of the photosensitive drum by the magnetic roller as mentioned above.

A developing device using the non-magnetic type one-component developer is also known, as disclosed in U.S. Pat. No. 3,152,012 and U.S. Pat. No. 3,754,963. This developing device includes a vessel for holding the non-magnetic type one-component developer, and a conductive elastic solid roller provided within the vessel as a developing roller in such a manner that a portion of the elastic roller is exposed therefrom and can be pressed against the surface of the photosensitive drum. The conductive elastic solid developing roller may be formed of a conductive silicone rubber material or a conductive polyurethane rubber material, as disclosed in Japanese Examined Patent Publication (Kokoku) No. 60-12627 and Japanese Unexamined Patent Publications (Kokai) No. 62-118372 and No. 63-189876. When the conductive solid rubber roller is rotated within the body of the non-magnetic type one-component developer held by the vessel, the toner particles composing the non-magnetic type one-component developer are frictionally entrained by the surface of the conductive solid rubber developing roller to form a developer layer therearound, whereby the toner particles can be brought to the surface of the photosensitive drum for the development of the electrostatic latent image formed thereon. The developing device further includes a blade member engaged with the surface of the developing roller, to uniformly regulate a thickness of the developer layer formed therearound so that an even development of the latent image can be carried out. The blade member also serves to electrically charge the toner particles by a triboelectrification therebetween. In this developing device, the development process is carried out in such a manner that, at the area of contact between the photosensitive drum and the conductive solid rubber developing roller carrying the developer layer, the charged toner particles are electrostatically attracted and adhered to the latent image due to a developing or bias voltage applied to the conductive solid rubber developing roller.

In the developing process, the remaining toner particles not used for the development of the latent image should be once removed from the developing roller, and then a fresh developer layer be formed thereon. This is because the developer layer formed of the remaining toner particles is subjected to physical and electrical affects during the developing process, to thereby hinder a physically and electrostatically even formation of the developer layer around the developing roller. As is obvious, the physically and electrostatically uneven formation of the developer layer around the developing roller will cause an uneven development of a latent image. Japanese Unexamined Patent Publication No. 61(1986)-43767 discloses the utilization of a toner-removing roller for removing the remaining toner particles from the developing roller. This toner-removing roller is made of a suitable conductive sponge rubber material, and is disposed to be in contact with the developing roller. The toner-removing roller is rotated in the same direction as the developing roller so that the surfaces of the toner-removing roller and the developing roller are rubbed against each other in counter directions at the contact area therebetween, whereby the remaining toner particles are mechanically removed from the developing roller. Also, a bias voltage is applied to the toner-removing roller so that the remaining toner particles are electrostatically attracted from the developing roller to the toner-removing roller.

Note, the prior toner-removing roller as mentioned above has a disadvantage of an early hardening thereof due to a penetration of the toner particles into the sponge structure of the toner-removing roller. When a hardness of the toner-removing roller becomes larger, i.e., when the toner-removing roller loses its softness, the remaining toner particles are squashed on the surface of the developing roller rather than being removed therefrom, and thus the squashed toner particles are firmly adhered to the surface of the developing roller, so that a proper development of a latent image cannot be obtained.

SUMMARY OF THE INVENTION

Therefore, an object of the present invention is to provide a developing device using a one-component developer, particularly a non-magnetic type one-component developer used in the electrophotographic field, which device comprises a conductive developing rubber roller for entraining and bringing the developer particles or toner particles to an electrostatic latent image forming body for a development of an electrostatic latent image formed thereon, and a toner-removing roller for removing the remaining toner particles, not used for the development of the latent image, from the electrostatic latent image forming body, wherein the toner-removing roller is constituted in such a manner that a softness thereof can be maintained over a long period, and thus the operating life of the toner-removing roller can be prolonged.

To achieve the above-mentioned object, in accordance with the present invention, there is provided a developing device using a one-component developer, which device comprises: a vessel for holding a one-component developer composed of toner particles; a developing roller rotatably provided within the vessel in such a manner that a portion of the developing roller is exposed therefrom and faces the surface of an electrostatic latent image carrying body; the developing roller being formed of a conductive rubber material by which the toner particles are entrained to to form a developer layer therearound and are carried to the surface of the electrostatic latent image carrying body for development of an electrostatic latent image formed thereon; a toner-removing roller rotatably provided within the vessel to be in contact with the developing roller for mechanically removing remaining toner particles not used for the development of the electrostatic latent image from the developing roller; the toner-removing roller being formed of a conductive open-cell foam rubber material so that pore openings appear over a surface of the toner-removing roller, and that a bias voltage is applied thereto to electrostatically remove the remaining toner particles from the developing roller; and the pore openings having a diameter which is at most twice an average diameter of the toner particles, whereby a penetration of the toner particles into the toner-removing roller is prevented.

Also, according to the present invention, there is provided a developing device using a one-component developer, which device comprises: a vessel for holding a one-component developer composed of toner particles; a developing roller rotatably provided within the vessel in such a manner that a portion of the developing roller is exposed therefrom and faces the surface of an electrostatic latent image carrying body; the developing roller being formed of a conductive rubber material by which the toner particles are entrained to to form a developer layer therearound and are carried to the surface of the electrostatic latent image carrying body for development of an electrostatic latent image formed thereon; a toner-removing roller rotatably provided within the vessel to be in contact with the developing roller for mechanically removing remaining toner particles not used for the development of the electrostatic latent image from the developing roller; the toner-removing roller being formed of a conductive open-cell foam rubber material so that pore openings appear over a surface of the toner-removing roller, and that a bias voltage is applied thereto to electrostatically feed the toner particles to the developing roller; and the pore openings having a diameter which is less than twice an average diameter of the toner particles, whereby a penetration of the toner particles into the toner-removing roller is prevented.

BRIEF DESCRIPTION OF THE DRAWINGS

The other objects and advantages of the present invention will be better understood from the following description, with reference to the accompanying drawings, in which:

FIG. 2 is a schematic view showing an embodiment of the developing device according to the present invention;

FIG. 3 is a partially enlarged schematic sectional view showing a open-cell foam rubber toner-removing roller incorporated into the developing device of FIG. 2;

DETAILED DESCRIPTION OF THE PREFERRED EMBODIMENTS

Figure 1:
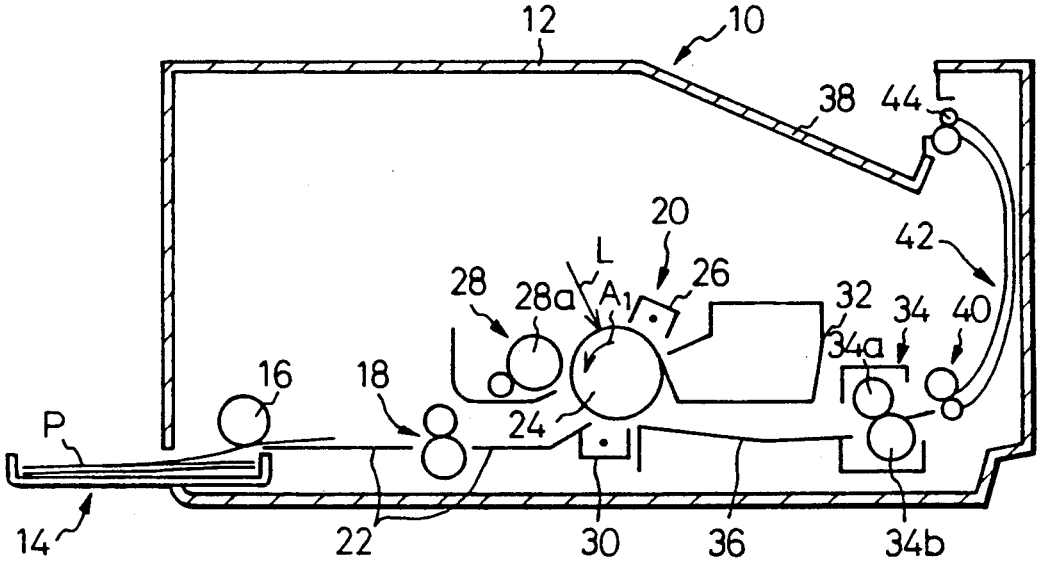
FIG. 1 is a schematic view showing an electrophotographic printer to which a developing device according to the present invention is applied.

FIG. 1 is a schematic diagram showing an electrophotographic printer, generally designated by reference numeral 10, to which a developing device using a non-magnetic type one-component developer according to the present invention is applied. The printer 10 includes a frame housing 12 provided with a sheet supply tray 14 incorporated into an end side wall of the frame housing 12 in the vicinity of a bottom thereof, and wherein a stack of sheets or paper to be printed is held. The sheet supply tray 14 is provided with a pick up roller 16 by which a paper P is drawn out one by one from the stack of sheet or paper held in the sheet supply tray 14. The drawn-out paper P is moved toward a pair of feed rollers 18 by which the paper P is then introduced into a recording or printing station, generally designated by reference numeral 20. Particularly, when a leading edge of the paper P enters between the feed rollers 18, an electric motor (not shown) for the feed rollers 18 is once stopped so that the paper P is stopped, and thereafter, the standby-condition of the paper P is released at a given timing, and thus the paper P is timely introduced into the printing station 20, whereby a recording or printing can be carried out at a proper position with respect to the paper P. Note, in FIG. 1, reference numeral 22 designates guide plates forming a travel path of the paper P.

At the printing station 20, a photosensitive drum 24 is placed as a latent image formation body, and is rotated at a constant speed in a direction indicated by an arrow A, during the printing operation. As shown in FIG. 1, a charger 26, a developing device 28, a transfer charger 30, and a cleaner 32 are successively disposed around the photosensitive drum 24 in the direction of rotation thereof. Note, the developing device 28 is constructed according to the present invention, and is shown together with the photosensitive drum 24 in FIG. 2.

As shown in FIG. 2, the photosensitive drum 24 comprises a sleeve substrate **24*a* made of a suitable conductive material such as aluminum, and a photoconductive material film 24*b* formed therearound. The sleeve substrate 24*a* is grounded as illustrated in FIG. 2, and the photoconductive material film 24*b*** may be composed of an organic photoconductor (OPC), a selenium photoconductor or the like.

The charger 26 may comprise a corona discharger. For example, when the photoconductive material film **24*b* of the drum 24 is made of the organic photoconductor, the charger 26 is arranged to apply negative charges to the surface (OPC) of the photosensitive drum 24, so that a uniform distribution of the charges is produced on the drum surface. The printer is provided with an optical writing means (not shown) such as a laser beam scanner, an LED (light emitting diode) array, an LCS (liquid crystal shutter) array, or the like, for forming an electrostatic latent image on the charge area of the photosensitive drum 24. As shown in FIG. 1, the charged area of the drum 24 is illuminated with a light beam L emitted from the optical writing means, and the charges are released from the illuminated zone through the grounded sleeve substrate 24*a***, so that a potential difference between the illuminated zone and the remaining zone forms an electrostatic latent image (i.e., the illuminated zone).

As shown in FIG. 2, the developing device 28 comprises a vessel **28*a* supported by a frame structure of the printer 10 in such a manner that the vessel 28*a* is movable toward and away from the photosensitive drum 24. The vessel 28 receives a non-magnetic type one-component developer D composed of colored fine toner particles of a suitable synthetic resin such as polyester and styrene acrylic resin, and usually having an average diameter of about 10 μm. Note, in FIG. 2**, the toner particles are symbolically illustrated as small open circles.

The developing device 28 also comprises a conductive rubber roller **28*b* rotatably provided within the vessel 28*a* as a developing roller, a portion of which is exposed from the vessel 28*a*. The vessel 28*a* is resiliently biased in a direction indicated by an arrow $A_2$, by a suitable resilient element (not shown) such as a coil or leaf spring, so that the exposed portion of the developing roller 28*b* is resiliently pressed against the surface of the photosensitive drum 24. During the operation of the developing device 28, the developing roller 28*b* is rotated in a direction indicated by arrow $A_3$, and frictionally entrains the toner particles to form a developer layer therearound, whereby the toner particles are brought to the surface of the photosensive drum 24 for the development of the latent image formed thereon. For example, the photosensitive drum 24 may have a diameter of 60 mm and a peripheral speed of 70 mm/s. Further, the developing roller 28*b* may have a diameter of 20 mm and a peripheral speed of from 1 to 4 times that of the photosensitive drum 24. The developing roller 28*b* includes a shaft rotatably supported by the walls of the vessel 28*a***, and a roller element mounted thereon.

The roller element of the developing roller **28*b* is preferably formed of a conductive open-cell foam rubber material such as a conductive open-cell polyurethane foam rubber material, a conductive open-cell silicone foam rubber material, or a conductive open-cell acrylonitrile-butadiene foam rubber material, whereby the toner particles can be effectively and stably entrained because they are captured and held in pore openings of the open-cell foam roller elements. If the developing roller formed of the rubber material has a solid surface (as disclosed in the above-mentioned Publications No. 60-12627, NO. 62-118372, and No. 63-189876), a coefficient of the surface friction thereof is changed by variations in the environment, particularly in the temperature and air moisture content. Accordingly, when the friction coefficient of the solid rubber developing roller becomes low, an amount of toner particles necessary for the development of the latent image cannot be entrained by the solid rubber developing roller. Also, when the developing roller 28*b* is made of the conductive open-cell foam rubber material, the developing roller 28*b* contributes to the electrical charging of the toner particles by a triboelectrification which occurs when the toner particles are captured by the pore openings of the roller element. Note, the roller element of the developing roller 28*b* preferably has a volume resistivity of about $10^4$ to $10^{10}$ Ω·m, most preferably $10^5$ Ω·m, and an Asker-C hardness of about 10° to 35°, most preferably 10°. The developing roller 28*b* is pressed against the photosensitive drum 24 with a linear pressure of about 22 to 50 g/cm, most preferably 43 g/cm, so that a contact or nip width of about 1 to 3.5 mm can be obtained between the developing roller 28*b* and the photosensitive drum 24**.

The developing device 28 further comprises a blade member **28*c* engaged with the surface of the developing roller 28*b* to uniformalize a thickness of the developer layer formed therearound, whereby an even development of the latent image is ensured. The blade member 28*c* is suitably supported so that it is resiliently pressed against the developing roller 28*b* at a linear pressure of about 26 g/mm, to regulate the thickness of the developer layer formed therearound. The blade member 28*c* may be formed of a suitable non-conductive or conductive rubber material, but preferably is coated with Teflon, and may be further formed of a suitable metal material such as aluminum, stainless steel, brass or the like. The blade member 28*c*** may also serve to electrically charge the toner particles by a triboelectrification therebetween.

The developing device 28 further comprises a toner-removing roller 28d rotatably provided within the vessel 28a and in contact with the developing roller 28b in such a manner that a contact or nip width of about 1 mm may be obtained therebetween. The toner-removing roller 28d is rotated in the same direction as the developing roller 28b, as indicated by an arrow $A_4$, so that the surfaces of the toner-removing roller 28d and the developing roller are rubbed up against each other in counter directions at the contact area therebetween, whereby remaining toner particles not used for the development of the latent image are mechanically removed from the developing roller 28b. The toner-removing roller 28d is formed of a conductive open-cell foam rubber material, preferably a conductive open-cell polyurethane foam rubber material which has a volume resistivity of about $10^6\ \Omega\cdot m$, and an Asker-C hardness of about 10° to 70°, most preferably 30°. For example, the toner-removing roller 28d may have a diameter of 11 mm, and a peripheral speed of from 0.5 to 2 times that of the developing roller 28b.

Further, the developing device 28 comprises an agitator 28e for agitating the non-magnetic type one-component developer D to eliminate a dead stock thereof from the vessel 28a. As shown in FIG. 2, the agitator 28e is rotated in a direction indicated by an arrow $A_5$, so that a portion of the developer D held in the vessel 28a is always moved toward the developing roller 28b.

In the operation of the developing device 28, when the photosensitive drum 24 is formed of an organic photoconductor (OPC) as mentioned above, a distribution of the negative charges is produced thereon, a charged area of which may have a potential of about −600 to −650 volts. In this case, the latent image zone formed on the drum 24 by the optical writing means may have a reduced potential of about −50 volts. On the other hand, the toner particles are given a negative charge by the triboelectrification with the developing roller 28b and the blade member 28c. When the open-cell foam rubber developing roller 28b is rotated within the developer D, the toner particles are captured and held in the pore openings in the surface of the developing roller 28b to form a developer layer therearound. After the developer layer is formed, the thickness thereof is regulated by the blade member 28c, and it is then brought to the surface of the photosensitive drum 24.

A developing bias voltage of −350 volts and (may be from about −200 to −500 volts) is applied to the developing roller 28b, as shown in FIG. 2, so that the toner particles carried to the surface of the photosensitive drum 24 are electrostatically attracted only to the latent image zone, as if the latent image zone or low potential zone (−50 volts) is charged with the negative toner particles, whereby the toner developed image or toner image can be obtained as a visible image. As mentioned above, the remaining toner particles not used for the development are mechanically removed from the developing roller 28b by the toner-removing roller 28d, but in the embodiment of FIG. 2, the remaining toner particles can be also electrostatically removed from the developing roller 18 by applying a bias voltage of −200 volts and (may be from about −150 to −400 volts) to the toner-removing roller 28d. Since the developer layer formed of the remaining toner particles is subjected to mechanical and electrical affects during the developing process, it should be removed from the developing roller 18 and then a fresh developer layer formed thereon.

When the blade member 28c is formed of the conductive material, a bias voltage of −450 volts and (may be from about −200 to −500 volts) may be applied thereto so that the charged toner particles are prevented from being electrostatically adhered to the blade member 28c. This is because, when the blade member has a relatively opposite polarity with respect to a potential of the developing bias voltage applied to the developing roller 28b, the toner particles are electrostatically adhered to the blade member 20c, to thereby hinder an even formation of the developer layer around the developing roller 28b. The application of the bias voltage to the blade member 20c also may contribute to the charging of the toner particles by a charge-injection effect.

Note, when the photocondutive drum 24 is formed of a selenium photoconductor, on which a distribution of positive charges is produced, the toner particles are positively charged and a positive bias voltage is applied to the developing roller 28b and the blade member 28c.

When the developed image or toner image reaches the transfer charger 30 due to the rotation of the photosensitive drum 24, the paper P, which has been released from the standby-condition, is introduced into a clearance between the drum 24 and the transfer charger 30. The transfer charger 30, which may also comprise a corona discharger, is arranged to give the paper P an electric charge having a polarity opposite to that of the toner image. That is, the transfer charge 30 gives the positive charge to the paper P, whereby the toner image is electrostatically transferred to the paper P. The paper P carrying the transferred toner image is then passed through a toner image fixing device 34, which comprises a heat roller 34a and a backup roller 34b. In particular, the toner particles forming the transferred toner image are heat-fused by the heat roller 34a so that the toner image is heat-fixed on the paper P. The residual toner particles not transferred to the paper P are removed from the surface of the photosensitive drum 24 by the cleaner 32, which may comprise a fur brush (not shown). The cleaned surface of the photosensitive drum 24 is illuminated by a suitable lamp (not shown), to eliminate the charge therefrom, and is then given a negative charge by the charger 12. Note, in FIG. 1, reference numeral 36 designates a guide plate forming a travel path of the paper P between the transfer charger 30 and the toner image fixing device 34. As shown in FIG. 1, the paper P carrying the fixed toner image is then travelled to a paper-receiving station 38 provided in a top wall of the frame housing 12, through a pair of feed rollers 40, a guide path 42, and a pair of feed rollers 44.

According to the present invention, the pore openings in the open-cell foam toner-removing roller 28d have a diameter which is at most twice the average diameter of the toner particles, whereby a penetration of the toner particles into the open-cell foam toner-removing roller 28d can be prevented. This is because, as shown in FIG. 3, when the open-cell foam toner-removing roller 28d has a pore opening PO having a diameter which is twice a diameter X of a toner particle T, the two toner particles T captured in the pore opening PO interfere with each other during the penetration thereof into the open-cell foam toner-removing roller 28d. When the toner particles have the average diameter of about 10 μm as mentioned above, the pore opening in the toner-removing roller 28d is given a diameter of at most 20 μm. Namely, a softness of the toner-removing roller 28d can be maintained, as it is not hardened by the penetration of the toner particles therein, whereby a long operating life of the toner-removing roller 28d is ensured and a proper development can be maintained over a long period.

Figure 4:
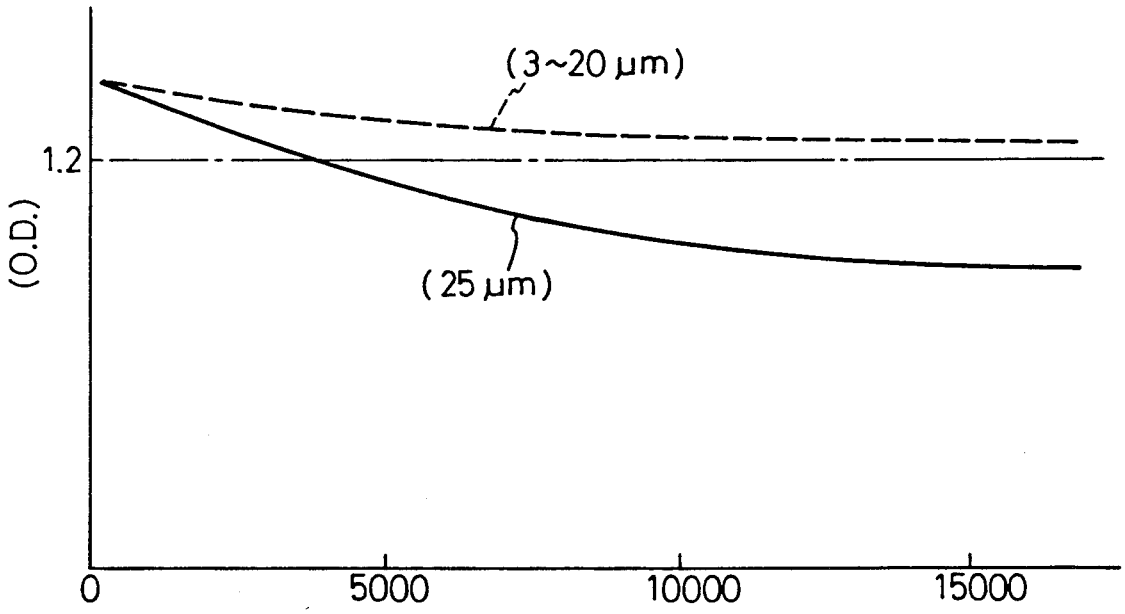
FIG. 4 is graph showing how an optical density of developed images varies as a number of printed sheets is increased when using two different toner-removing rollers having a pore opening diameter of from 3 to 20 μm and a pore opening diameter more than twice 20 μm, respectively.

FIG. 4 shows how an optical density (O.D.) of the fixed image or printed image varies as a number of printed sheets is increased. In FIG. 4, a broken line denotes a characteristic curve when using a open-cell foam toner-removing roller having a pore opening diameter which is within 3 to 20 μm, a solid line denotes a characteristic curve when using a open-cell foam toner-removing roller having a pore opening diameter (25 μm) which is more than twice the average diameter of the toner particles, and a chain line denotes a border line of 1.2 (O.D.), an optical density more than is necessary for obtaining a visually noticeable image upon printing. Note, the average diameter of the toner particles is 10 μm.

As apparent from FIG. 4, when using the open-cell foam toner-removing roller having the pore opening diameter which is within 3 to 20 μm; i.e., the open-cell foam toner-removing roller arranged in accordance with the present invention, an optical density of more than 1.2 is obtained even after the number of printed papers has exceeded 15,000, which shows that there is very little penetration of the toner particles into the pore openings of the toner-removing roller. On the other hand, when using the open-cell foam toner-removing roller having the pore opening diameter (25 μm) which is more than twice the average diameter of the toner particles, an optical density of more than 1.2 is mainained merely until the number of printed papers reached about 4,000, which shows that the toner-removing roller is hardened by the penetration of the toner particles therein, so that the remaining toner particles not used for the development of the latent image are squashed on the surface of the developing roller rather than being removed therefrom, due to the hardening of the toner-removing roller. The squashed toner particles are firmly adhered to the surface of the developing roller, and thus reduce electric lines formed between the developing roller 28b and the photosensitive drum 24 by applying the developing bias voltage to the developing roller 28b, to thereby weaken an electrostatic attraction force for moving the toner particles from the developing roller 28b to the latent image zone of the photosensitive drum 24.

In the above-mentioned embodiment, even though the bias voltage of −200 volts having a higher potential than the developing bias voltage of −350 volts is applied to the toner-removing roller 28d, so that the remaining toner pariticles not used for the development of the latent image are electrostatically removed from the photosensitive drum 24, this application of the bias voltage to the toner-removing roller 28d can be eliminated because the remaining toner pariticles can be sufficiently removed from the photosensitive drum 24 by only the mechanical action of the toner-removing roller 28d.

According to another aspect of the present invention, a bias voltage (for example, −400 volts) having a lower potential than the developing bias voltage of −350 volts may be applied to the toner-removing roller 28d, to electrostatically feed fresh toner particles to the developing roller 28b. In particular, at the upper side of the nip between the toner-removing roller 28d and the developing roller 28b, the fresh toner particles entrained by the toner-removing roller 28d are electrostatically attracted to the developing roller 28b because the bias voltage (−400 volts) applied to the toner-removing roller 28d has the lower potential than the developing bias voltage (−350 volts) applied to the developing roller 28b. Note, at the lower side of the nip between the toner-removing roller 28d and the developing roller 28b, the remaining toner particles are mechanically removed from the developing roller 28b by the toner-removing roller 28d. In this case, the pore openings of the toner-removing roller 28d may have a diameter which is more than twice the average diameter of the toner particles, because the penetration of the toner particles into the toner-removing roller 28d can be prevented by the bias voltage applied thereto, having a lower potential than the developing bias voltage of −350 volts.

Figure 5:
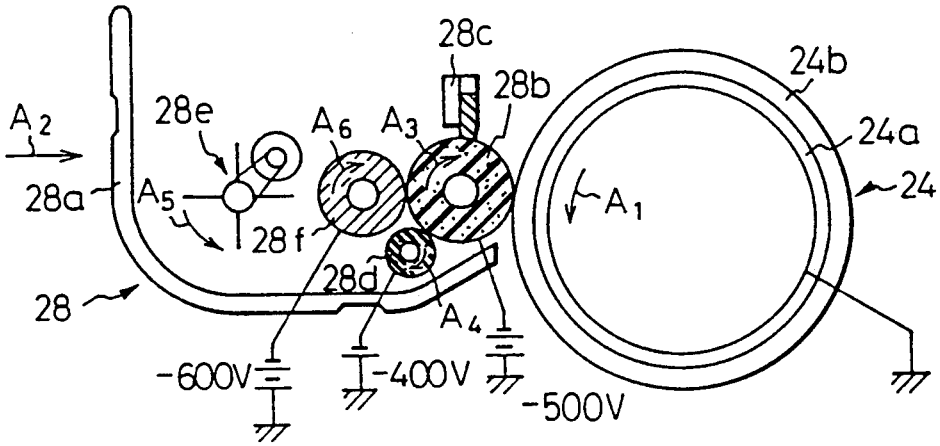
FIG. 5 is a schematic view showing another embodiment of a developing device according to the present invention.

FIG. 5 shows another embodiment of the developing device according to the present invention, which is substantially identical to the first embodiment of FIG. 2 except that the developing device of FIG. 5 further includes a fur brush roller 28f in contact with the developing roller 28b, and that bias voltages of −500 and −400 volts are applied to the developing and toner-removing rollers 28b and 28d, respectively. The fur brush roller 28f is rotated in the same direction as the developing roller 28b, as indicated by an arrow $A_6$, and a bias voltage of −600 volts is applied thereto, whereby fresh toner particles can be electrostatically fed to the developing roller 28b. The developing device of FIG. 5 is also characterized in that the pore openings of the toner-removing roller have a diameter which is at most twice the average diameter of the toner particles. Also, as in the first embodiment of FIG. 2, when the blade member 28c is formed of a conductive material, a bias voltage having a lower potential than the developing bias voltage (−500 volts) of the developing roller 28b is applied thereto so that the charged toner particles are prevented from being electrostatically adhered to the blade member 28c.

Figure 6:
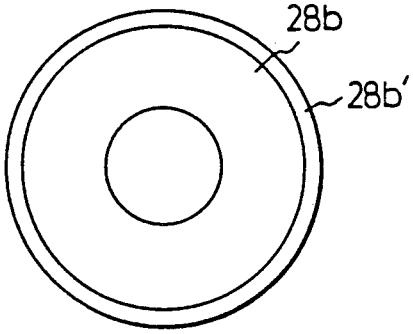
FIG. 6 is a schematic view showing a modification of the developing roller used in the developing device according to the present invention.

When the developing roller 28b is made of a conductive rubber material based upon polyurethane, silicone or the like, having a coefficient of frinction which is on the order of about 2.0, a stick slip may occur at the contact zone between the developing roller 28b and the blade member 28c. The stick slip results in a varying of a thickness of the developer layer formed around the developing roller 28b. Namely, when the stick slip occurs, it is impossible for the blade member 28c to evenly regulate the developer layer, and thus an even development of a latent image cannot be obtained. The stick slip, however, can be eliminated by coating the surface of the developing roller with a suitable coating material such as a polyurethane resin-based material having a coefficient of friction of about from 0.4 to 1.5, as shown in FIG. 6 in which the coated film is indicated by reference numeral 28b'.

Figure 7:
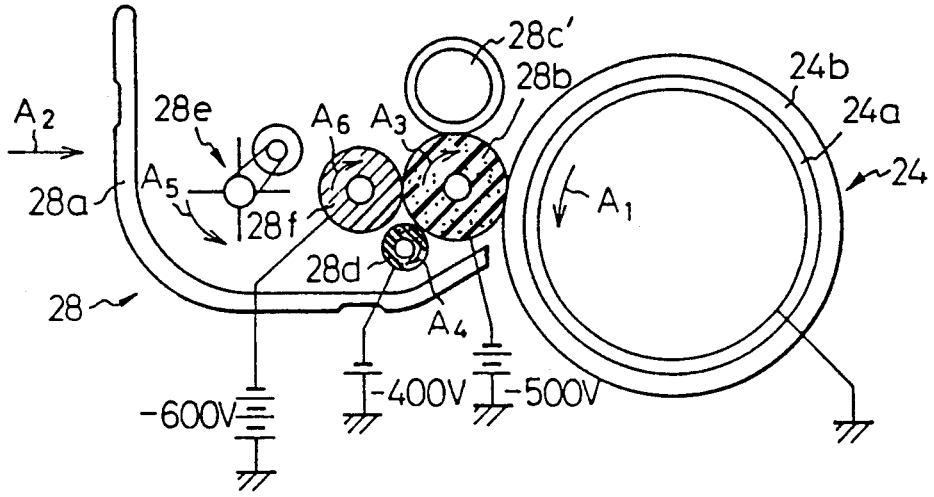
FIG. 7 is a schematic view showing a modification of the embodiment shown in FIG. 5.

FIG. 7 shows a modification of the embodiment shown in FIG. 5. This modified embodiment is identical to the developing device of FIG. 5 except that a roller member 28c' is used, instead of the blade member 28c, to regulate the thickness of the developer layer formed around the developing roller 28b. Similar to the blade member 28c, the roller member 28c may be formed of a non-conductive or conductive rubber material and preferably is coated with Teflon, and further, may be formed of a suitable metal material such as aluminum, stainless steel, brass or the like. The roller member 28c' is rotated in the same direction as the developing roller 28b. In this modified embodiment, by varying a peripherical speed of the roller member 28c' with respect to a peripheral speed of the developing roller 18, not only can the thickness of the developer layer be easily regulated, but also triboelectrification can be actively caused between the roller member 28c' and the developing roller 28b. Further, it is possible to easily eliminate the stick slip between the roller member 28c' and the developing roller 28b.

Figure 8:
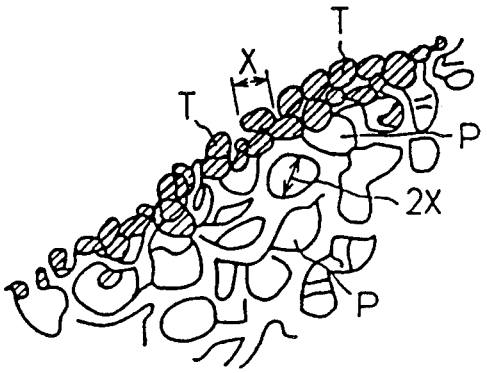
FIG. 8 is a partially enlarged schematic sectional view showing a open-cell foam rubber developing roller preferably used in the developing device according to the present invention.

As stated hereinbefore, preferably, the roller element of the developing roller 28b is made of a conductive open-cell foam rubber material. In this case, as shown in FIG. 8, pore openings PO' in the open-cell foam rubber developing roller 28b should have a diameter which is at most twice an average diameter X of the toner particles T, because a penetration of the toner particles into the open-cell foam rubber developing roller 28b can be prevented for the same reasons as in the toner-removeing roller 28d. Namely, a softness of the roller element 18b can be maintained since it is not hardened by the penetration of the toner particles therein, whereby a long operating life of the developing roller can be ensured and a proper development can be maintained, as easily understood from the following descriptions with reference to FIGS. 9 and 10.

Figure 9:
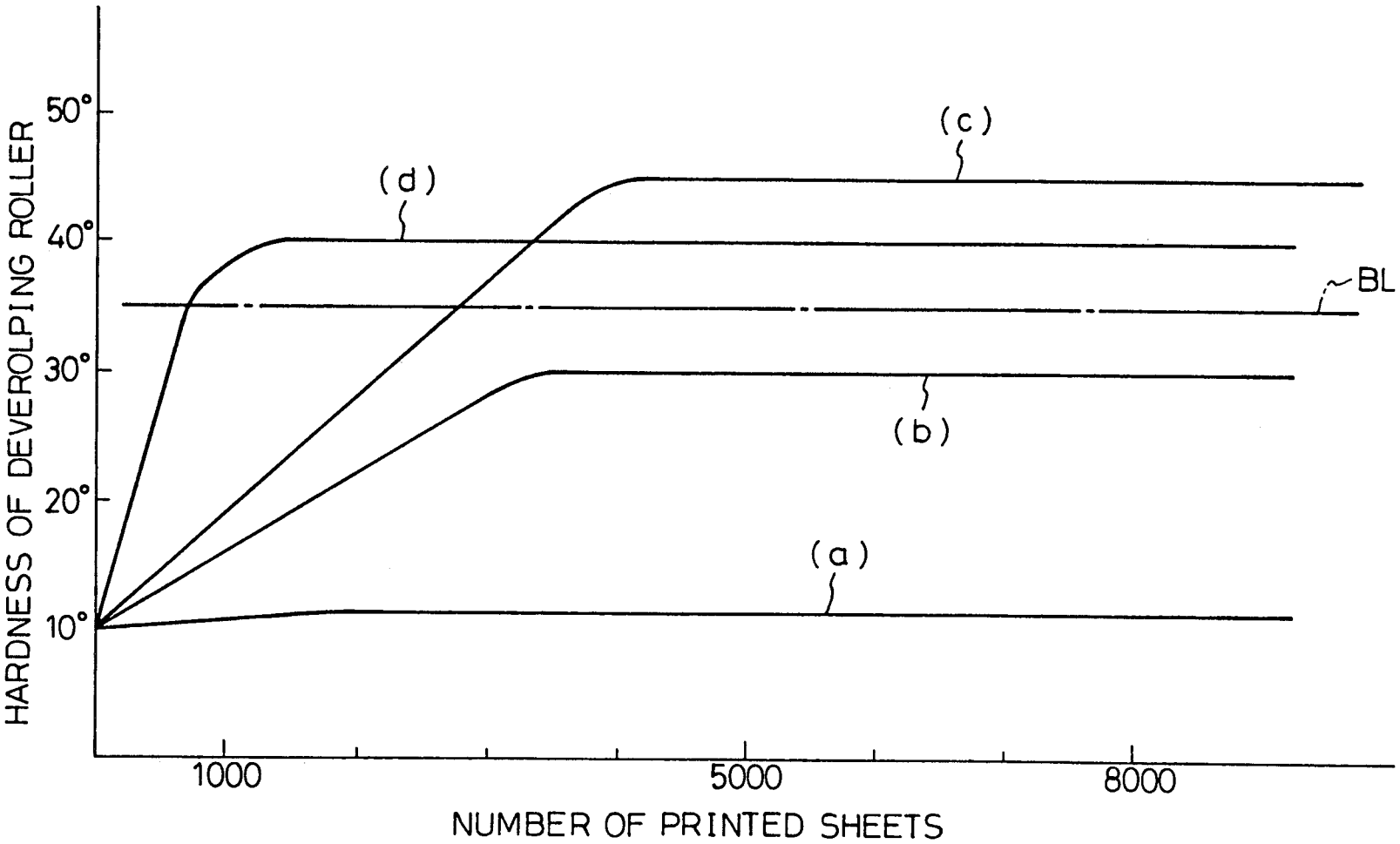
FIG. 9 is a graph showing how a hardness of each of conductive open-cell foam rubber developing rollers having pore opening diameters of 10, 20, 50, and 100 μm varies as a number of printed sheets is increased.
Figure 10:
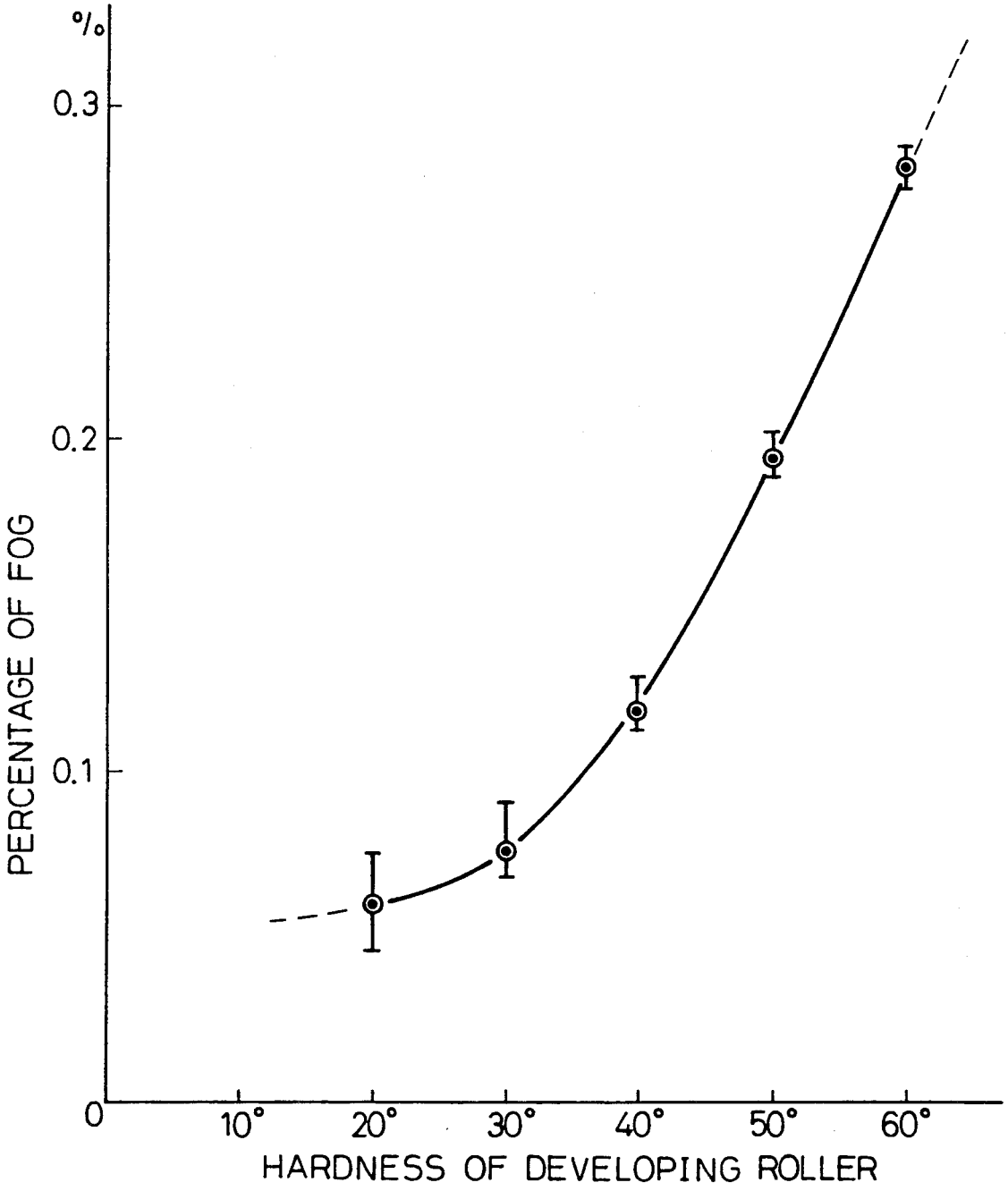
FIG. 10 is a graph showing how a percentage of electrophotograhic fog which may appear during the development process varies as the hardness of the conductive open-cell foam rubber developing roller is raised.

FIG. 9 shows how a hardness of developing rollers having pore opening diameters of 10, 20, 50, and 100 μm varies as a number of printed sheets is increased, and FIG. 10 shows how a percentage of electrophotographic fog which may appear during the development process varies as a hardness of the developing roller is raised. Note, when the hardness of the developing roller becomes large due to the penetration of the toner particles therein, a force by which the toner particles are held at the surface of the developing roller is weakened, and thus some of the toner particles can be adhered to the surface zone of the photosensitive drum other than the latent image zone thereof, thereby causing the electrophotographic fog during the development process. In FIG. 9, (a), (b), (c), and (d) denote developing rollers having the pore opening diameters of 10, 20, 50, and 100 μm, respectively. Note, in tests carried out to obtain the results shown in FIGS. 9 and 10, toner particles having an average diameter of 10 μm were used. As apparent from FIG. 9, an initial hardness of the developing roller having a pore opening diameter of 10 μm is maintained even after the number of printed sheets has exceeded 8,000, which shows that there is very little penetration of the toner particles into the pore openings of the open-cell foam rubber developing roller. The hardness of the developing rollers having the pore opening diameters of 20, 50, and 100 μm is gradually increased until the number of printed sheets reaches about 3,500, 4,000, and 1,500, respectively, and then constantly maintained. This, of course, means that each of these developing rollers has been hardened by the penetration of the toner particles into the pore openings thereof. As apparent from FIG. 10, the larger the hardness of the developing roller, the greater the increase in the percentage of electrophotographic fog. For example, if an electrophotographic fog of 0.1% is permissible, the hardness of the developing roller may be increased to the Asker C-hardness of about 35° by the penetration of the toner particles into the pore openings thereof. Accordingly, a developing roller having pore opening diameters of at most 20 μm, the hardness of which does not exceed a border line BL of 35° shown in FIG. 9, is most preferable.

Figure 11:
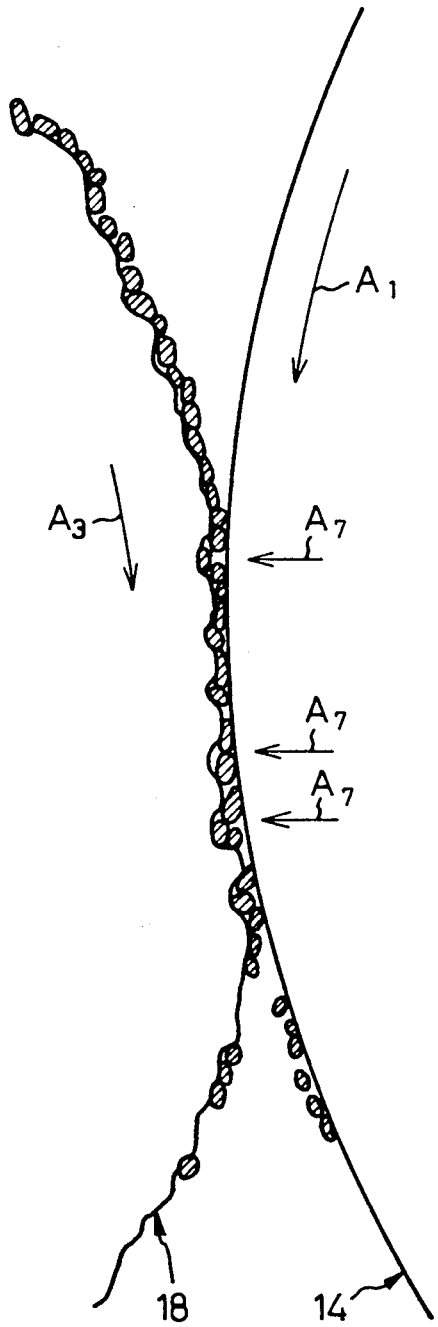
FIG. 11 is a partially enlarged schematic sectional view showing a developing or contact area between a photosensitive drum and the open-cell foam rubber developing roller resiliently pressed thereagainst.

When the pore opening diameter of the developing roller is more than twice the average diameter of the toner particles, or when the pore diameter of the developing roller is more than 20 μm, this brings the disadvantage of an uneven development of the latent image. In particular, as shown in FIG. 11, the electric field produced by applying the developing bias voltage to the developing roller 28b is weakened at locations (indicated by arrows $A_7$) at which the pore openings have a diameter of more than 20 μm, because of the larger space formed between the developing roller 28b and the photosensitive drum 24, and thus an amount of toner particles moved from the pore openings having a diameter of more than 20 μm toward the latent image zone of the drum 24 is reduced, whereby an uneven development of the latent image occurs.

When the diameter of the pore openings of the developing roller is less than one-fourth of the average diameter of the toner particles, it is impossible for the pore openings to capture the toner particles, and thus a sufficient amount of the toner particles cannot be entrained by the developing roller, whereby an underdevelopment occurs. Accordingly, in the developing roller, the diameter of the pore openings must be within from one-fourth to twice the average diameter of the toner particles.

Figure 12:
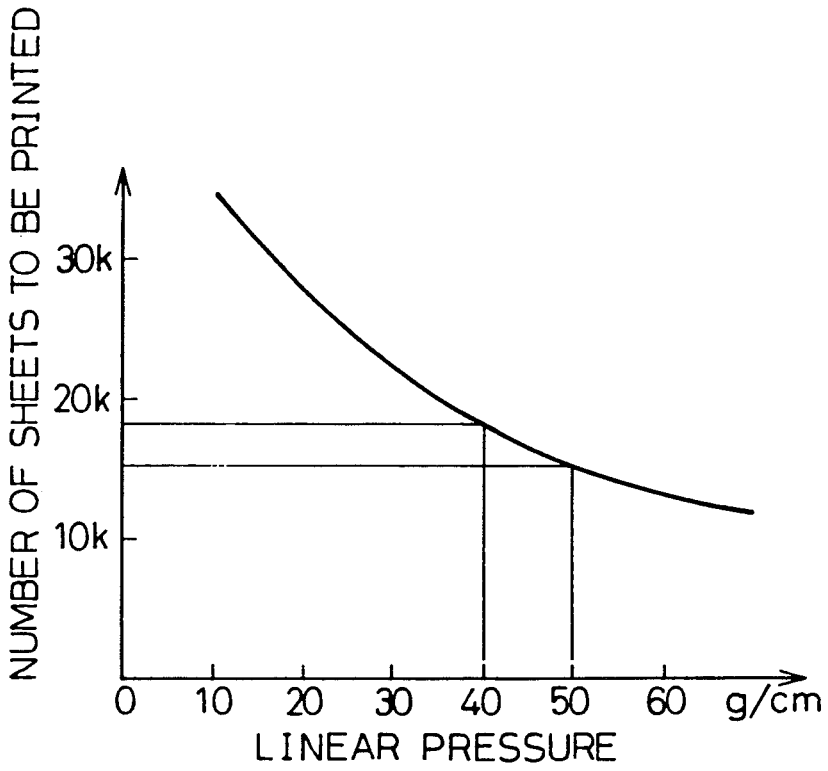
FIG. 12 is a graph showing a relationship between a linear pressure at which the developing open-cell foam rubber is pressed against the photosensitive drum and a maximum number of sheets which can be printed by the photosensitive drum.
Figure 13:
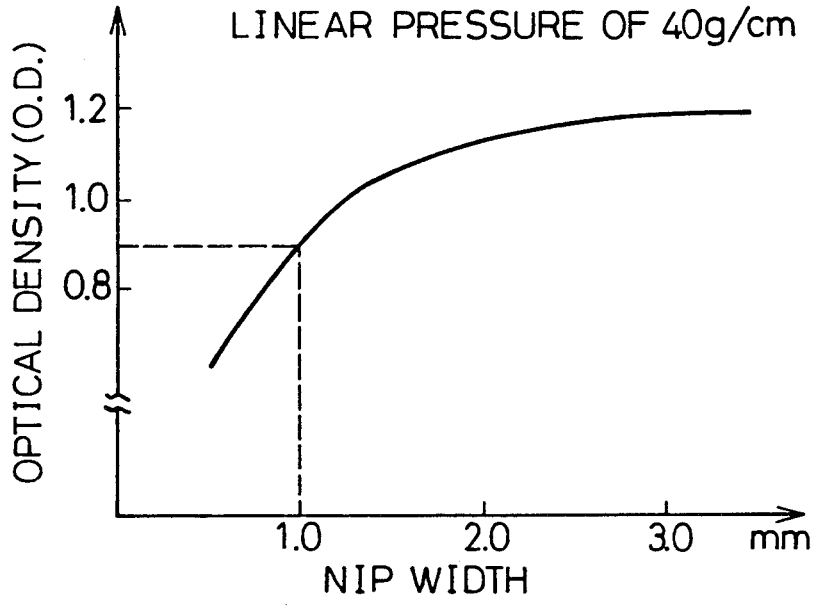
FIG. 13 is a graph showing a relationship between an optical density (O.D.) of a developed image and a contact or nip width between the open-cell foam rubber developing roller and the photosensitive drum.
Figure 14:
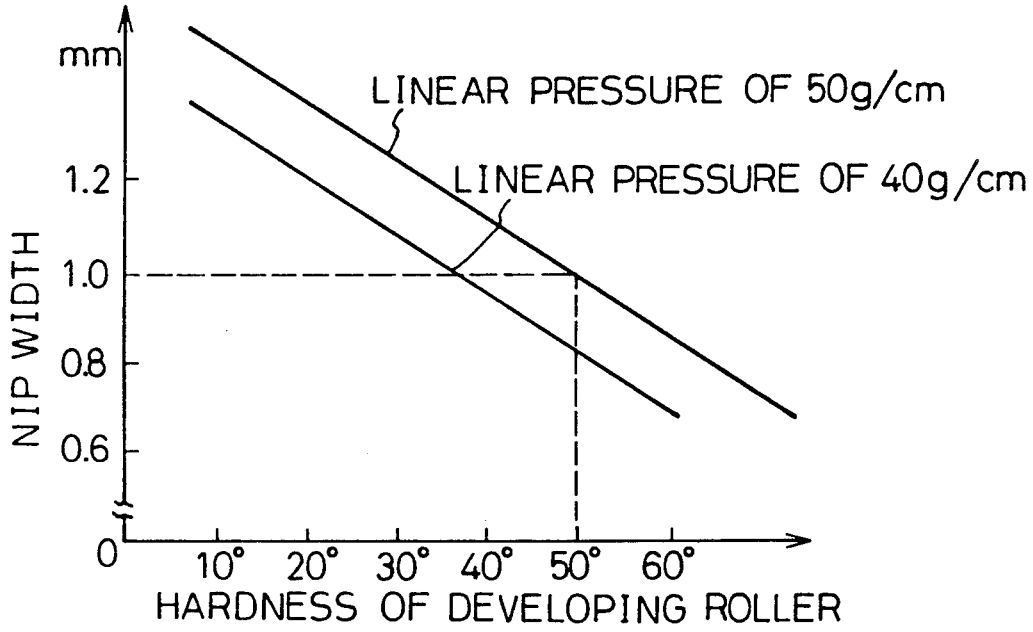
FIG. 14 is a graph showing a relationship between a hardness of the open-cell foam rubber developing roller and a nip width between the open-cell foam rubber developing roller and the photosensitive drum.

Also, according to the present invention, the developing roller 28b is constituted so as to be given an Asker C-hardness of at most 50°, preferably 35°, because the harder the developing roller 28b, the greater the wear of the photosensitive film 24b of the drum 24, whereby the operating life of the drum 24 is shortened. As shown in FIG. 12, the higher the linear pressure at which the developing roller is pressed against the photosensitive drum, the lower the number of sheets which can be printed by the photosensitive drum. For example, when the photosensitive drum is required to withstand a printing of more than 15,000 sheets, the developing roller must be pressed against the drum at a linear pressure of at most 50 g/cm. On the other hand, as shown in FIG. 13, the larger a contact or nip width between the developing roller and the drum, the higher an optical density (O.D.) of the developed image. For example, when the developing roller is pressed against the drum at a linear pressure of 40 g/cm, the nip width therebetween must be at least 1 mm before an optical density of more than about 0.9 necessary for the development process can be obtained. Note, a nip width of more than 1.5 mm is preferable for obtaining a developed image with a required optical density. Also, as shown in FIG. 14, the lower the hardness of the developing roller, the larger the nip width between the developing roller and the drum. For example, when a developing roller having an Asker C-hardness of 50° is pressed against the drum at a linear pressure 50 g/cm, the nip width therebetween is 1 mm, whereas when a developing roller having an Asker C-hardness of 40° is pressed against the drum at the same linear pressure, the nip width therebetween is 1.1 mm. Accordingly, the Asker C-hardness of the developing roller should be at most 50°, to enable the photosensitive drum to print more than 15,000 sheets. Note, preferably a developing roller having an Asker C-hardness of less than 35° is pressed against the drum in such a manner that the nip width therebetween is from 1 to 3.5 mm.

Figure 15:
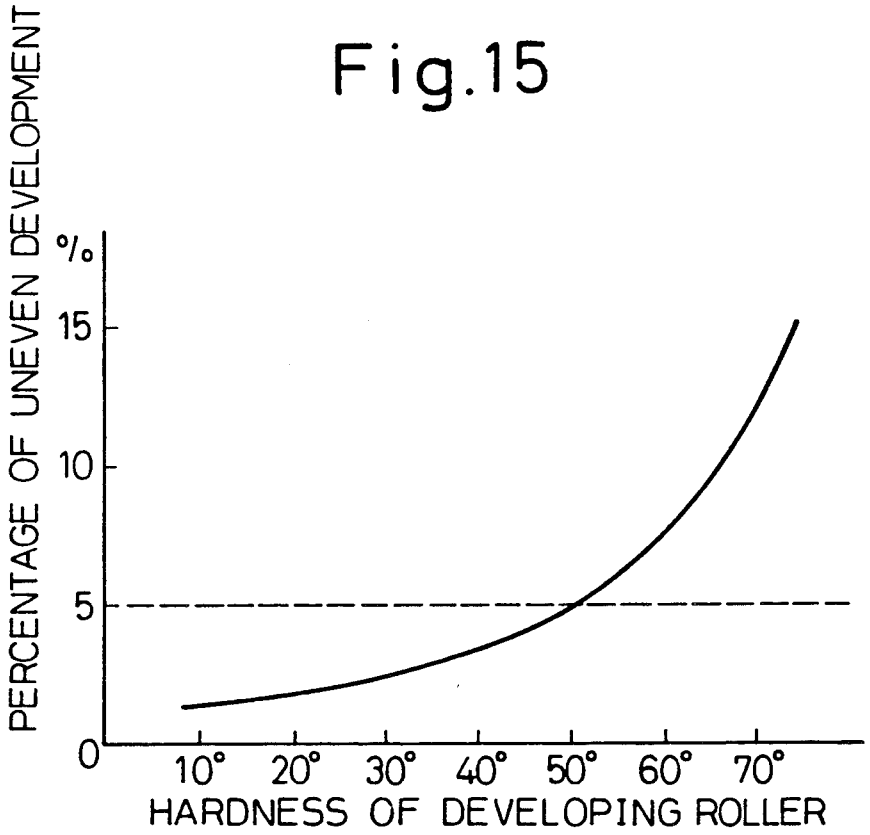
FIG. 15 is a graph showing a relationship between a hardness of the open-cell foam rubber developing roller and a percentage of uneven development.
Figure 16:
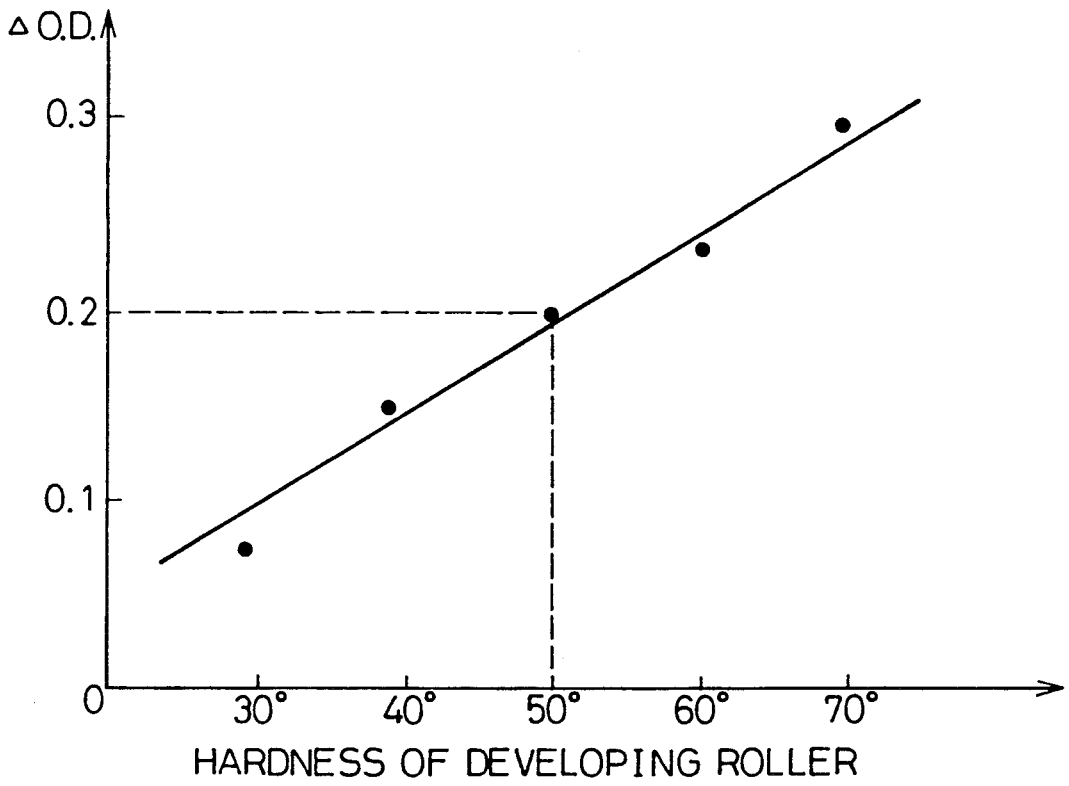
FIG. 16 is a graph showing a relationship between a hardness of the open-cell foam rubber developing roller and a difference between the highest and lowest optical densities when printing a sheet solidly with a black developer.

When the blade member 28c is made of a metal material such as aluminim, stainless steel, brass or the like, the developing roller 28b must have an Asker C-hardness of at most 50°. The metal blade member has a treated and finished surface which is engaged with the developing roller to regulate the thickness of the developer layer formed therearound. In general, a possible accuracy of the finished surface of the metal blade member is on the order of about 30 μm, but this may be rough relative to toner particles having an average diameter of 10 μm, so that the regulated thickness of the developer layer is made uneven due to the rough surface of the metal blade member, to thereby cause an uneven development of the latent image. The greater the hardness of the developing roller, the greater the variation of the developer thickness, and thus the uneven development becomes more noticeable as shown in FIG. 15. In this drawing, the abscissa shows a hardness of the developing roller, and the ordinate shows a percentage of uneven development when a sheet is printed solidly with a black developer. For example, if an uneven development of at most 0.5%, which is not visually noticeable, is permissible, as indicated by a broken line in FIG. 15, the developing roller must have an Asker C-hardness of at most 50°. Also, FIG. 16 shows a relationship between a hardness of the developing roller and a difference (ΔO.D.) between the highest and lowest optical densities when printing a sheet solidly with a black developer. Similarly, the difference of 0.2 (ΔO.D.), which is not visiually noticeable, corresponds to the Asker C-hardness of about 50°, as indicated by broken lines in FIG. 16.

Figure 17:
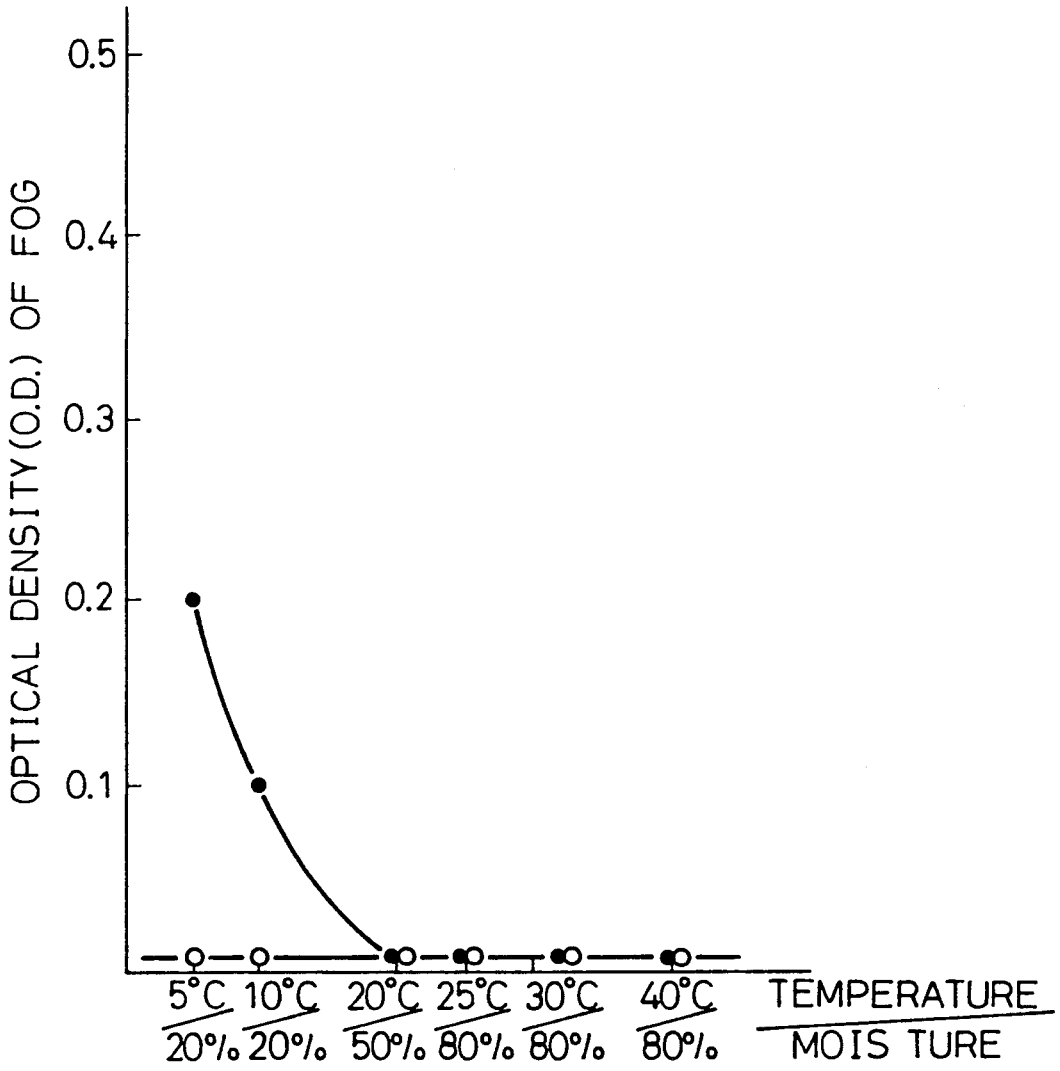
FIG. 17 is a graph showing a relationship between a variation of the temperature and air moisture content and an optical density (O.D.) of an electrophotographic fog appearing when using each of the open-cell foam rubber developing roller having an Asker hardness of 20° and the solid rubber developing roller having an Asker hardness of 58°.

In general, a hardness of the synthetic rubber material such as a polyurethane rubber material, upon which the open-cell foam rubber developing roller 28b according to the present invention and the conventional solid rubber developing roller as mentioned above may be based, is made greater by a drop in temperature and air moisture content. Also, a coefficient of friction of the synthetic rubber material such as a polyurethane rubber material is lowered by a drop in temperature and air moisture content, as mentioned above. As a result, when using a conventional solid rubber developing roller, a toner density for the development is lowered because the toner particles cannot be sufficiently entrained by the solid roller, and an electrophotographic fog appears because the toner particles cannot be firmly held by the solid rubber developing roller. On the contrary, regardless of variations of temperature and air moisture content, the hardness of the developing roller according to the present invention cannot be greatly lowered because of the open-cell foam structure thereof, and the toner particles are easily captured and firmly held by the pore openings of the open-cell foam rubber developing roller. Thus, when the open-cell foam rubber developing roller 28b as mentioned above is used, the electrophotographic fog can be substantially eliminated even though the temperature and air moisture content are varied. FIG. 17 shows a relationship between a variation of temperature and air moisture content and an optical density (O.D.) of an electrophotographic fog when using a open-cell foam rubber developing roller having an Asker hardness of 20° and a solid rubber developing roller having an Asker hardness of 58°. Note, in FIG. 17, open circles and solid circles correspond to the open-cell foam rubber developing roller having an Asker hardness of 20° and the solid rubber developing roller having an Asker hardness of 58°, respectively. As apparent from FIG. 17, when the open-cell foam rubber developing roller having an Asker hardness of 20° was used, the electrophotographic fog was substantially eliminated even though the temperature and air moisture content had dropped, whereas when the solid rubber developing roller having an Asker hardness of 58° was used, an optical density of the electrophotographic fog was gradually increased when the temperature and air moisture content fell below 25° C. and 50%, respectively.

Furthermore, according to the present invention, the developing roller 28b is preferably formed of the conductive polyurethane foam rubber material. When the triboelectrification between the developing roller 28b and the toner particles is utilized for charging the toner particles (note, triboelectrification occurs when the toner particles are captured by the pore openings of the developing roller), the developing roller 28b should be formed of the conductive polyurethane foam rubber material, not the conductive silicone foam rubber material, because the toner particles charged by using the polyuretane foam rubber developing roller can be given a charge distribution that ensures a proper development of a latent image.

Figure 18:
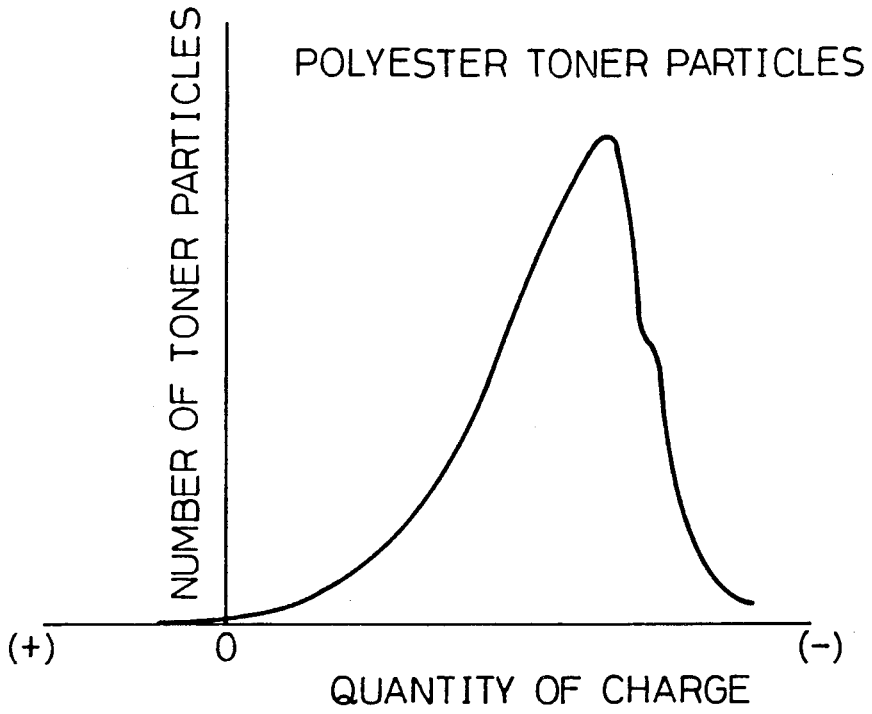
FIG. 18 is a graph showing a charge distribution of polyester resin-based toner particles when being charged by using a polyurethane foam rubber developing roller.
Figure 19:
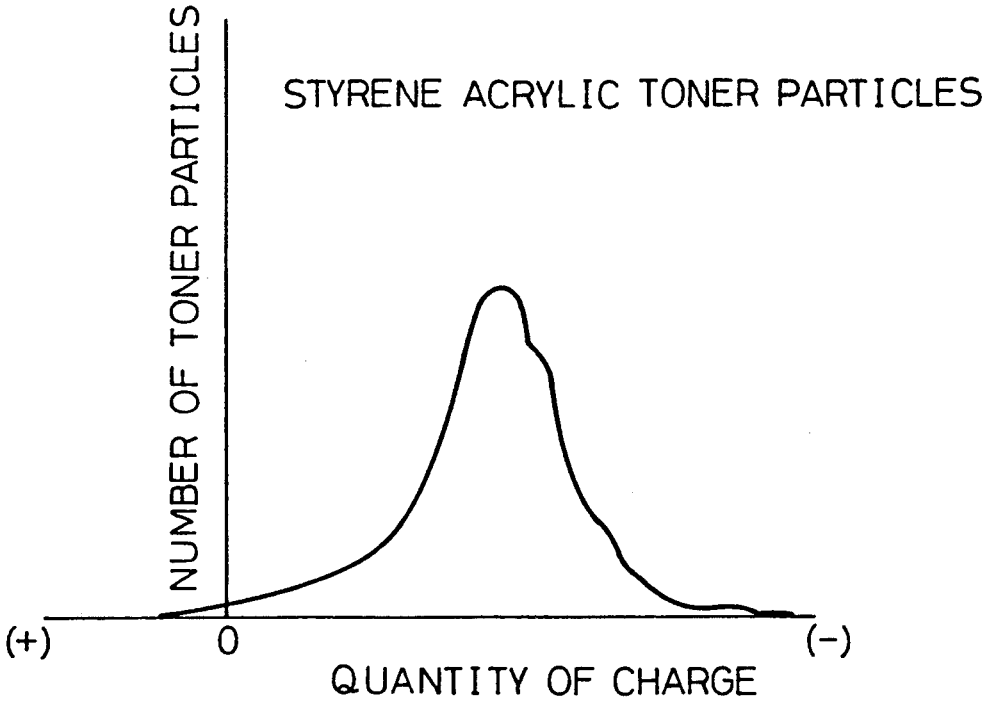
FIG. 19 is a graph showing a charge distribution of styrene acrylic resin-based toner particles when being charged by using the polyurethane foam rubber developing roller.
Figure 20:
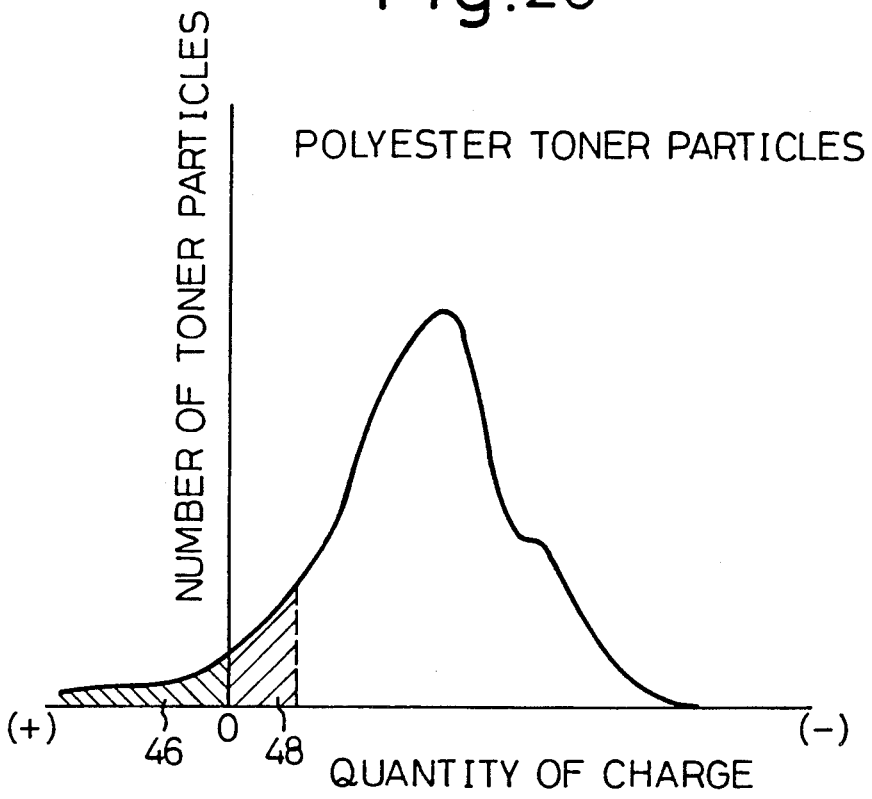
FIG. 20 is a graph showing a charge distribution of the polyester resin-based toner particles when being charged by using a silicone foam rubber developing roller.
Figure 21:
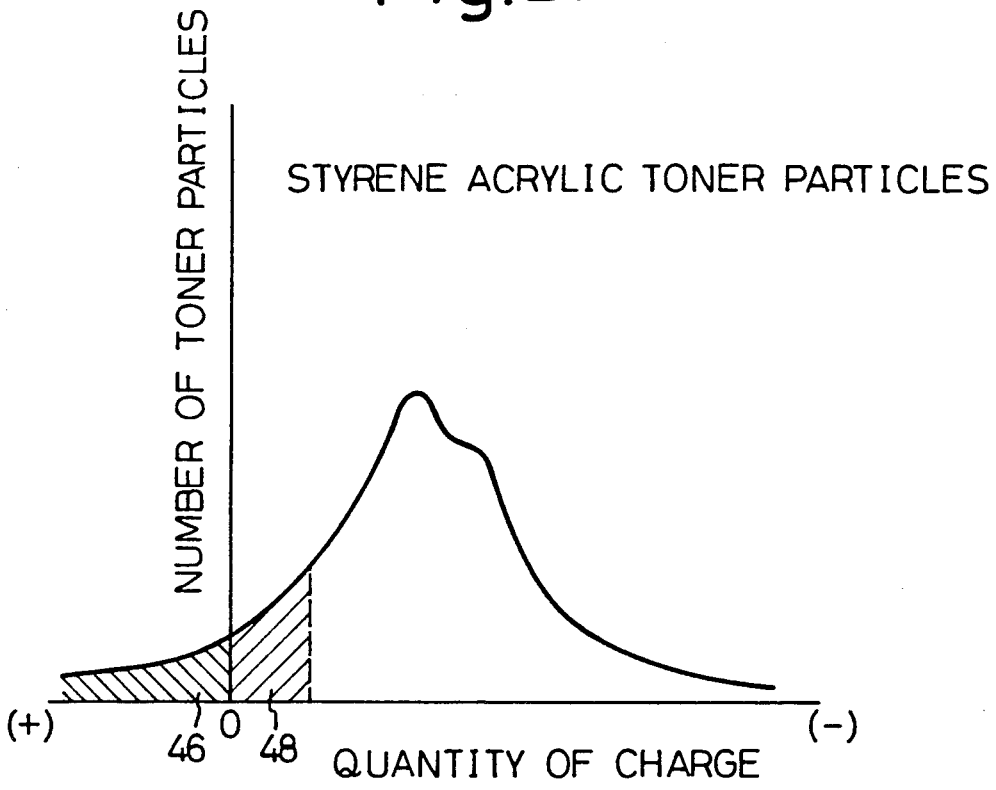
FIG. 21 is a graph showing a charge distribution of the styrene acrylic resin-based toner particles when being charged by using the silicone foam rubber developing roller.

For example, when the photosensitive drum 24 is formed of the organic photoconductor (OPC), the polyester or styrene acrylic resin-based developer is used so that the toner particles thereof are given a negative charge. FIG. 18 shows a charge distribution of the polyester resin-based toner particles when charged while using the polyurethane foam rubber developing roller, and FIG. 19 shows a charge distribution of the styrene acrylic resin-based toner particles when charged while using the polyurethane foam rubber developing roller. Further, FIG. 20 shows a charge distribution of the polyester resin-based toner particles when charged while using the silicone foam rubber developing roller, and FIG. 21 shows a charge distribution of the styrene acrylic resin-based toner particles when charged while using the silicone foam rubber developing roller. Note, in each of FIGS. 18, 19, 20 and 21, the abscissa and the ordinate indicate a quantity of charge and a number of toner particles, respectively. As apparent from these drawings, when the polyurethane foam rubber developing roller is used, the polyester resin-based and styrene acrylic resin-based developers substantially do not contain toner particles having a positive charge, whereas when using the silicone foam rubber developing roller, the polyester resin-based and styrene acrylic resin-based developers contain not only a positively-charged part of the toner particles indicated by reference numeral 46, but also a low-level negatively-charged part of the toner particles indicated by reference numeral 48. This is assumed to be because the polyurethane foam rubber developing roller is neutral with regard to frictional electrification, whereas the silicon foam rubber developing roller is positive-high with regard to frictional electrification. In particular, the silicone foam rubber developing roller may be overcharged because of the positive-high characteristics thereof with regard to frictional electrification, so that an eletrical discharge between the silicone foam rubber developing roller and the blade member 28c may occur, whereby a part of the toner particle is subjected to a positive charge. Note, the charge distributions of the toner particles shown in FIGS. 20 and 21 cannot ensure a proper development of a latent image because the positively-charged toner particles and the low-level negatively-charged toner particles may adhere to the surface of the photosensitive drum, except for the latent image zones, and thus the developer is prematurely consumed. Also, although the positively-charged toner particles adhered to the photosensitive drum cannot be transferred to a sheet or paper, the low-level negatively-charged toner particles can be transferred from the photosensitive drum to the sheet or paper, thereby causing an electrophotographic fog to appear thereon. Accordingly, when the triboelectrification between the developing roller 28b and the toner particles is utilized for charging the toner particles, the roller element thereof is preferably formed of the conductive polyurethane foam rubber material.

Furthermore, when the developing roller 28b is formed of the conductive polyurethane foam rubber material, not the conductive silicone foam rubber material, another advantage of maintaining a resolution of a developed image, and therefore a printed image, at a high level and over a long period can be obtained. Variations of the resolution were measured where the polyurethane foam rubber developing roller and the silicone foam rubber developing roller were incorporated into electrophotographic printers having a dot density of 300 dpi (dots per inch). In the measurement, a sample pattern including a plularity of dot lines spaced from each other by a line space corresponding to the dot line was repeatedly printed out on a sheet or paper, and then a reflection density DB (reflected light intensity) from the dot lines and a reflection density DW (reflected light intensity) from the line spaces were determined from the printed sample pattern. The resolution was evaluated by a percentage R obtained from the following formula:

$$R = \frac{\sum_{i=1}^{n} DW_i/n}{\sum_{i=1}^{n} DB_i/n} \times 100\ (\%)$$

Figure 22:
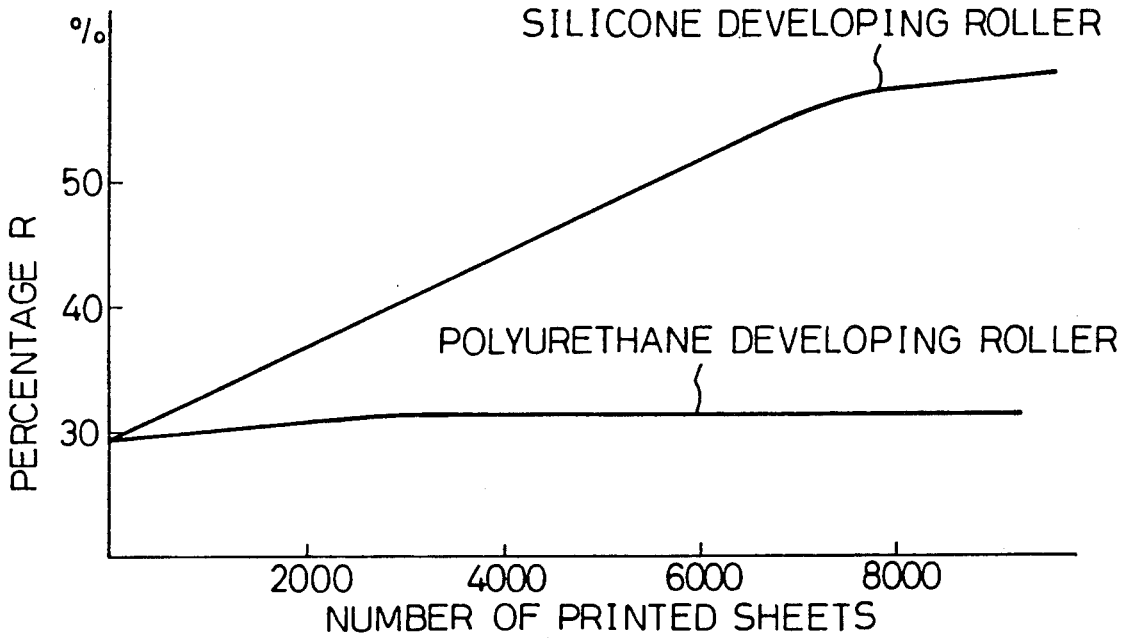
FIG. 22 is a graph showing how a resolving power of a developed image varies as a number of printed sheets is increased when using the polyurethane foam rubber developing roller and the silicone foam rubber developing roller.

Wherein: "n" indicates a number of dot lines or line spaces. As apparent from this formula, the smaller the percentage R, the greater the resolution. Note, when the precentage R exceeds 60%, the resolution derived therefrom is practically unacceptable. The results of this measurement are shown in FIG. 22, and as shown in this drawing, when the polyurethane foam rubber developing roller is used, the percentage R is constantly maintained at 30% throughout a printing of more than 8,000 sheets, whereas when the silicone foam rubber developing roller is used, the percentage R is raised to the limit of 60% when the number of printed sheets reaches about 8,000. This is assumed to be because the polyurethane foam rubber developing roller has a superior wear resistance to the silicone foam rubber developing roller, whereby a surface characteristic of the silicone foam rubber developing roller is easily deteriorated by the frictional engagement with the photosensitive drum 24 and the blade member 28c, in comparison with the polyurethane foam rubber developing roller.

Furthermore, according to the present invention, the developing roller 28b and the blade member 28c are preferably constituted in such a manner that the work functions thereof are smaller or larger than that of the developer. When the triboelectrification between the developing roller 28b and blade member 28c and the toner particles is utilized for charging the toner particles, these work functions should be smaller or larger than that of the developer, as this enables the charged toner particles thereof to be given a charge distribution by which a proper development of a latent image is obtained.

Figure 23:
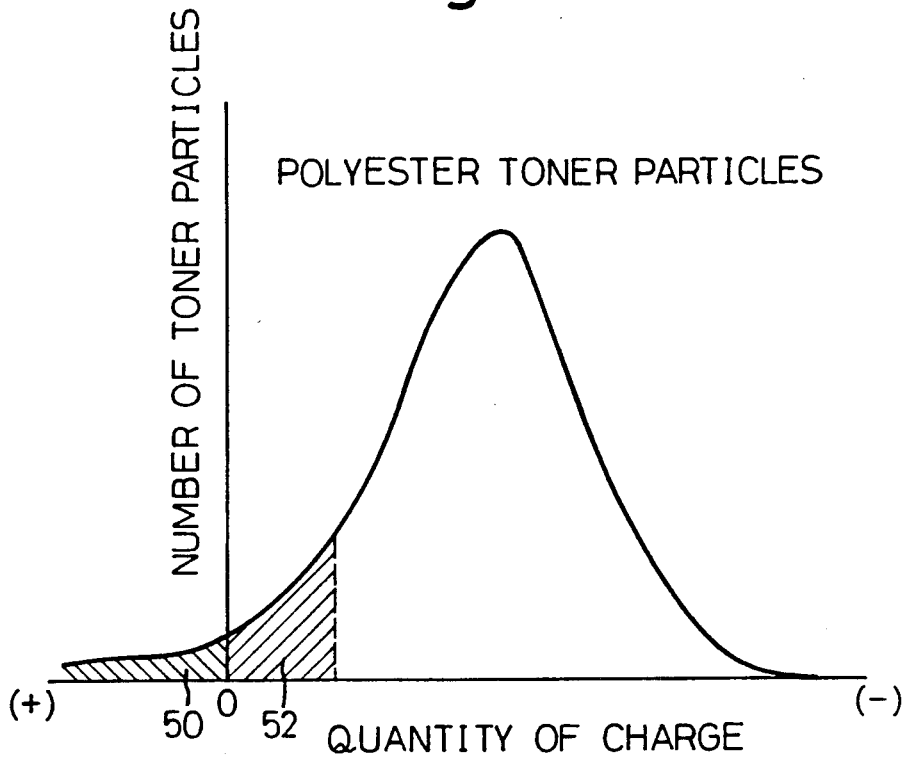
FIG. 23 is a graph showing a charge distribution of the polyester resin-based toner particles when being charged by a triboelectrification while using the polyurethane foam rubber developing roller and a Teflon-coated rubber blade member.
Figure 24:
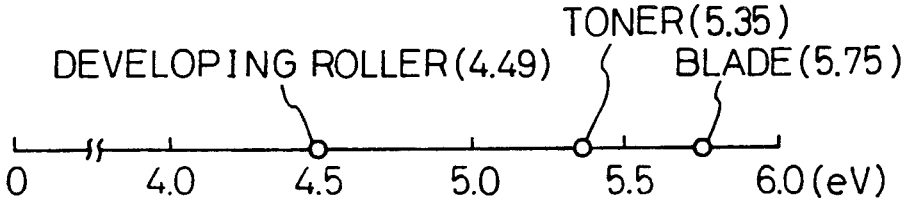
FIG. 24 is a work function scale for comparing the work functions of the polyurethane foam rubber developing roller, the Teflon-coated rubber blade member, and the polyester resin-based toner particles.

For example, when the polyester resin-based toner particles are charged by using the developing roller formed of the conductive polyurethane foam rubber material and the blade member formed of the Teflon-coated rubber material, the charged polyester resin-based toner particles are given a charge distribution as shown in FIG. 23, which is similar to the charge distribution of FIG. 20. Namely, the polyester resin-based developer charged by using the polyurethane foam rubber developing roller includes a positively-charged part of the toner particles indicated by reference numeral 50, and a low-level negatively-charged part of the toner particles indicated by reference numeral 52. This is assumed to be because a work function of the Teflon-coated rubber blade member is larger than that of the polyester resin-based toner particles, and thus even though the toner particles are negatively charged by the polyurethane foam rubber developing roller, the negative charge of the toner particles is weakened by the blade member having a work function smaller than that of the toner particles, whereby a part of the toner particles can be given a positive charge. In practice, measurements proved that the polyurethane foam rubber developing roller, the polyester resin-based toner particles, and the Teflon-coated rubber blade member have the work functions of 4.49, 5.35, and 5.75 eV, respectively, as shown in FIG. 24.

Figure 25:
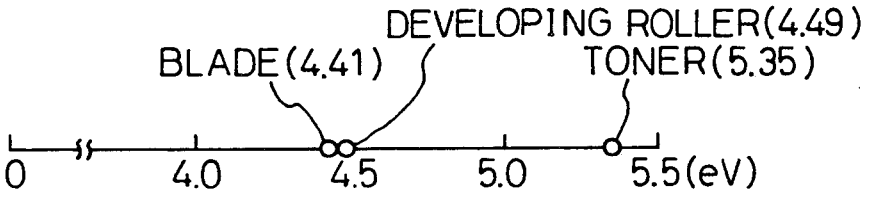
FIG. 25 is a work function scale for comparing the work functions of the polyurethane foam rubber developing roller, an aluminum blade member, and the polyester resin-based toner particles.
Figure 26:
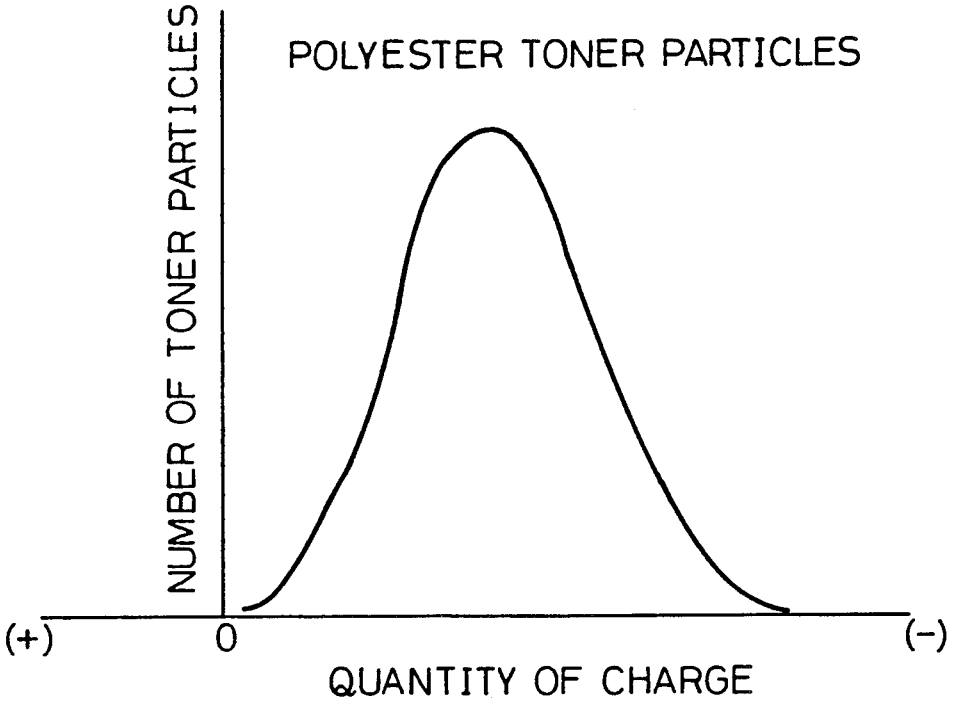
FIG. 26 is a graph showing a charge distribution of the polyester resin-based toner particles when charged by a triboelectrification while using the polyurethane foam rubber developing roller and the aluminum blade member.

When the toner particles have the charge distribution as shown in FIG. 23, for the same reasons as mentioned above, the developer also may be prematurely consumed and a photographic fog may appear. Nevertheless, these disadvantages can be surmounted by forming the blade member 28c of a metal material having a relatively small work function. For example, when the blade member is formed of aluminum having a work function of 4.41 eV, the work functions of the polyurethane foam rubber developing roller and blade member are less than that of the polyester resin-based toner particles, as shown in FIG. 25, so that the polyester resin-based toner particles can be negatively charged by the polyurethane foam rubber developing roller and the blade member. As a result, the charged polyester resin-based toner particles are given a desired charge distribution, as shown in FIG. 26.

The polyester resin-based toner particles having a work function of 5.35 eV were produced from the following raw materials:

| | |
|---|---|
| (1) polyester resin: (acid values 45; melting point 145° C.) | 93 pbw (parts by weight) |
| (2) carbon: (Black Pearls L: Cabot Corp.) | 3 pbw |
| (3) polypropylene wax: (Biscol 550P: Sanyo Kasei K. K.) | 1 pbw |
| (4) azo dye: (Aizen Spilon Black TRH: Hodogaya Chemical Corp. Ltd.) | 2 pbw |

Note, the polyester resin was obtained by a condensation of terephthalic acid, trimellitic acid, and diol having the structural formula below:

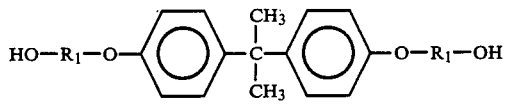

Wherein, $R_1$ is $C_nH_{2n}$ ($1 \leqq n \leqq 5$).

In the production steps, these raw materials were mixed, fused, kneaded, and then powdered to produce fine particles having a diameter of from 5 to 15 μm.

Also, when another type of azo dye (S34: Orient Chemical K.K.) was substituted for the azo dye (Aizen Spilon Black TRH: Hodogaya Chemical Corp. Ltd.), the polyester resin-based toner particles obtained had a work function of 5.60 eV, which is larger than the work functions of the polyurethane foam rubber developing roller and the aluminum blade member.

The styrene acrylic resin-based toner particles also can be used, as long as a work function thereof is larger than the work functions of the polyurethane foam rubber developing roller and the aluminum blade member. In practice, styrene acrylic resin-based toner particles having a work function of 5.25 eV, which is larger than the work functions of the polyurethane foam rubber developing roller and the aluminum blade member, were produced by using the following raw materials:

| | |
|---|---|
| (1) styrene acrylic resin: (melting point 140° C.) | 90 pbw |
| (2) carbon: (Black Pearls L: Cabot Corp.) | 5 pbw |
| (3) polypropylene wax: (Biscol 550P: Sanyo Kasei K. K.) | 3 pbw |
| (4) azo dye: (Aizen Spilon Black TRH: Hodogaya Chemical Corp. Ltd.) | 2 pbw |

Note, the styrene acrylic resin was obtained by a copolymerization of styrene and n-butylacrylate.

In the production steps, these raw materials were mixed, fused, kneaded, and then powdered into fine particles having a diameter of from 5 to 15 μm.

Namely, when the toner particles are to be given a negative charge, the desired charge distribution can be obtained by constituting the developing roller and the blade member in such a manner that the work functions thereof are less than that of the toner particles.

On the other hand, when the toner particles are to be given the positive charge, the desired charge distribution can be obtained by constituting the developing roller and the blade member in such a manner that the work functions thereof are larger than that of the toner particles. For example, polyester resin-based toner particles having a work function of 5.35 eV or styrene acrylic resin-based toner particles having a work function of 5.25 eV can be given a positive charge by using the Teflon-coated rubber blade member having a work function of 5.75 eV and by coating the polyurethane foam rubber developing roller with Teflon to give a work function of 5.75 eV thereto. Note, the Teflon-coating of the developing roller should be carried out in such a manner that that the pore openings existing in the surface thereof are not covered over.

Furthermore, according to the present invention, the developing roller **28*b*** and the developer D are preferably constituted in such a manner that the triboelectrification therebetween does not participate in the charging of the toner particles, as much as possible, because the triboelectrification therebetween is affected by variations in the environment, particularly, temperature and air moisture content changes, and thus although the work functions of the developing roller and the blade member are smaller or larger than that of the developer as mentioned above, the charged toner particls cannot be always given the desired charge distribution.

Figure 27:
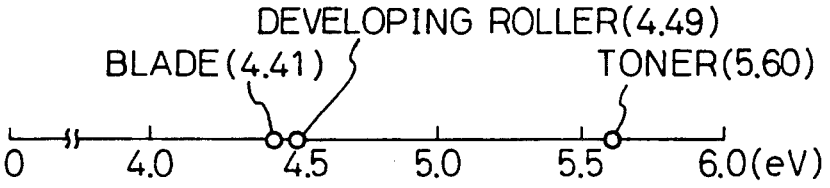
FIG. 27 is a work function scale for comparing the work functions of the polyurethane foam rubber developing roller, the aluminum blade member, and another type of polyester resin-based toner particles.
Figure 28A:
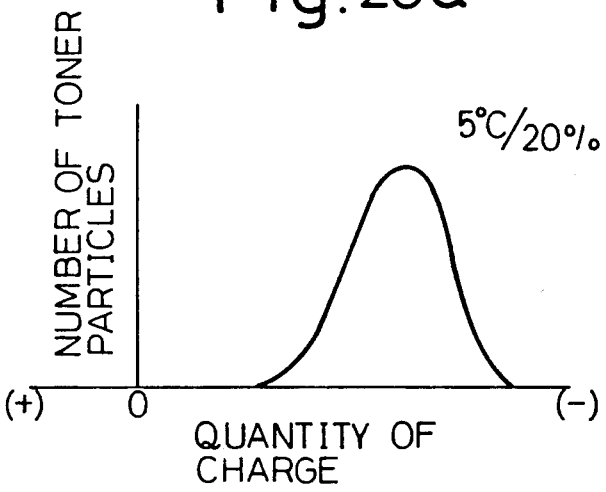
FIGS. 28(*a*), 28(*b*), and 28(*c*) are graphs showing a charge distribution of the polyester resin-based toner particles referred to in FIG. 27 when charged by a triboelectrification while using the polyurethane foam rubber developing roller.
Figure 28B:
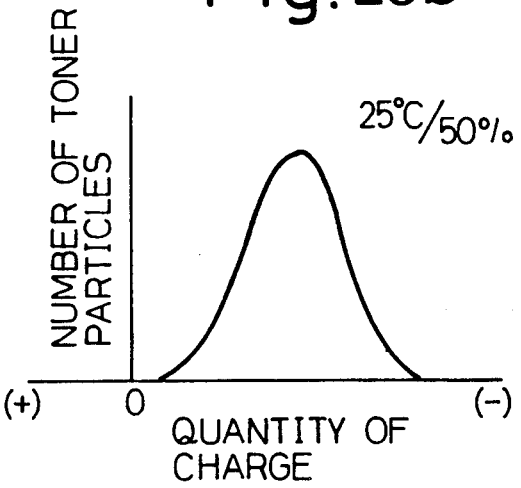
Figure 28C:
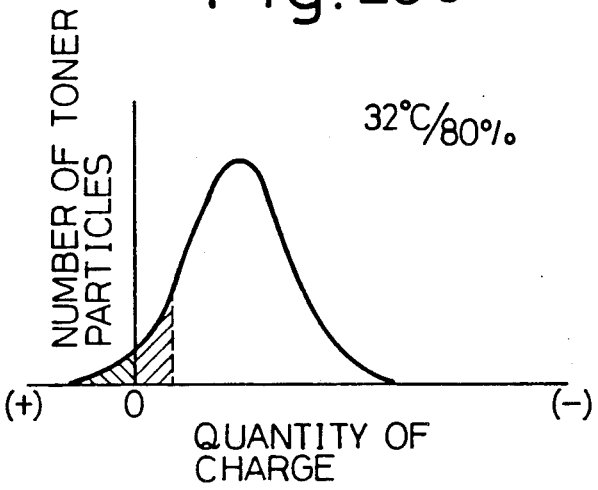

For example, when using the aluminum blade member, the polyurethane foam rubber developing roller, and the polyester resin-based toner particles, having the work functions of 4.41, 4.49, and 5.60 eV as shown in FIG. 27, a charge distribution of the toner particles is easily changed by a variation of the temperature and air moisture content, as shown in FIGS. 28(*a*), 28(*b*), and 28(*c*). Namely, when the temperature and air moisture content are 5° C. and 20%, respectively, the toner particles are given a charge distribution as shown in FIG. 28(*a*), but when the temperature and air moisture content are raised from 5° C. and 20% to 25° C. and 50%, respectively, the charge distribution of the toner particles is shifted toward the positive side, as shown in FIG. 28(*b*), and when the temperature and air moisture content are raised to 32° C. and 80%, respectively, the charge distribution of the toner particles is further shifted toward the positive side, as shown in FIG. 28(*c*). This is assumed to be because the water contents of the developing roller and the toner particles are changeable in response to variations of the temperature and air moisture content. The charge distributions shown in FIGS. 28(*a*) and 28(*b*) ensure a proper development of a latent image, but the charge distribution shown in FIG. 28(*c*) do not, because the toner particles include positively-charged and low-level negatively charged parts, as shown by the hatchings in FIG. 28(*c*).

Figure 29:
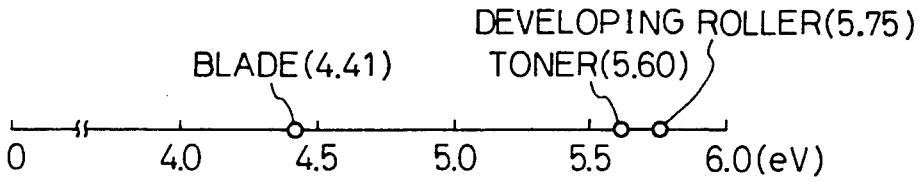
FIG. 29 is a work function scale for comparing the work functions of a Teflon-coated polyurethane foam rubber developing roller, the aluminum blade member, and the polyester resin-based toner particles referred to in FIG. 27.
Figure 30A:
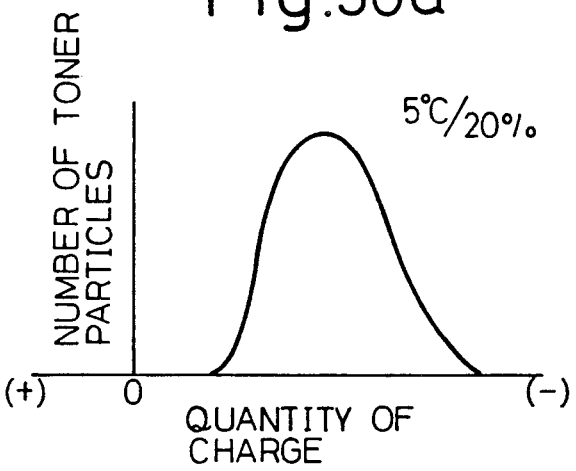
FIGS. 30(*a*), 30(*b*), and 30(*c*) are graphs showing a charge distribution of the polyester resin-based toner particles referred to in FIG. 27 when charged by a triboelectrification while using the aluminum blade member.
Figure 30B:
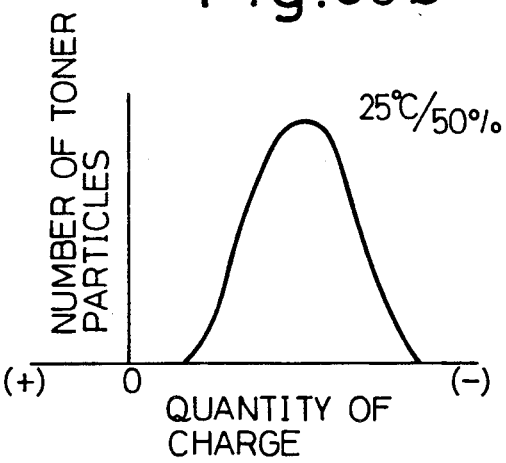
Figure 30C:
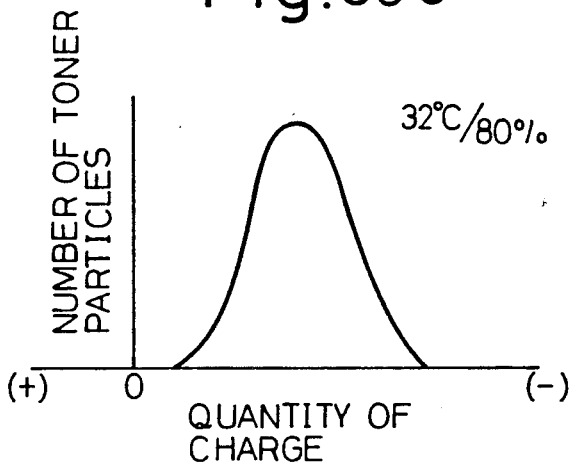

Accordingly, when the electrophotographic printer is used under high temperature and air moisture content conditions, the developing roller and the developer should be constituted in such a manner that the triboelectrification therebetween does not participate in the charging of the toner particles, as much as possible. This can be carried out by ensuring that the work functions of the developing roller and the developer conform with each other as much as possible. For example, by coating the polyurethane foam rubber developing roller with Teflon, it can be given the work function of 5.75 eV, as mentioned above, which is approximate to the work function of 5.60 eV as shown in FIG. 29. In this case, the charging of the toner particles may be positively carried out by the aluminum blade member having the work function of 4.41 eV, so that a charge distribution thereof is relatively stable regardless of variations of the temperature and air moisture content, as shown in FIGS. 30(*a*), 30(*b*), and 30(*c*). In particular, as apparent from these drawings, the charge distribution may be shifted slightly to the positive side in response to a raise in the temperature and air moisture content, but even though the temperature and air moisture content are raised to 32° C. and 80%, respectively, the charge distribution does not include positively charged toner particles.

In the present invention, the developing roller **28*b*, the blade member 28*c*, and the developer may be constituted in such a manner that the work functions thereof approximate each other, whereby the triboelectrification between the developing roller and blade member and the toner particles does not participate in the charging of the toner particles, as much as possible. In this case, the charging of the toner particles is carried out by the charge-injection effect resulting from the application of a bias voltage to the conductive blade member 28***c*. For example, by coating the polyurethane foam rubber developing roller and the conductive rubber blade member with Teflon, and by using the polyester resin-based toner particles having the work function of 5.60 eV, the work functions thereof may approximate each other because the polyurethane foam rubber developing roller and the conductive rubber blade member can be given the work function of 5.75 eV by the Teflon coating, as mentioned above. When the work functions of the developing roller 28*b*, the blade member 28*c*, and the developer approximate each other, the charging of the toner particles can be substantially protected from the affect of variations of the temperature and air moisture content, and thus the charge distribution of the toner particles is made more stable. Note, in practice it is possible to give a charge of $-10\pm1$ $\mu q/g$ to the toner particles when a bias voltage of $-200$ volts is applied to the blade member 28*c*.

In the present invention, the charge-injection effect may be utilized in cooperation with the triboelectrification for charging the toner particles. When the charge-injection effect is utilized for charging the toner particles, a difference between the bias voltage applied to the blade member and the developing bias voltage applied to the developing roller should be within a predetermined range, because when the difference is small enough to allow the electrostatical adhesion of the toner particles to the blade member, an even formation of the developer layer around the developing roller may not be possible, and because when the difference is large enough to cause a high electrical current or an electrical discharge between the blade member and the developing roller, not only the toner particles but also the developing roller may be fused due to generation of the Joule heat. For example, when the polyurethane foam rubber developing roller, the aluminum blade member, and the polyester resin based toner particles are used, the difference between the bias voltage applied to the blade member and the developing bias voltage applied to the developing roller should be within the range of from $-20$ to $-200$ volts, as shown in the following table.

| Voltage of Blade | Voltage Difference between Blade and Roller | Changes at Roller | Changes at Blade |
|---|---|---|---|
| −650 V | −350 V | Recesses Formed in Roller Surface by Fusion | Fused Toner Adhered to Blade |
| −600 V | −300 V | Fused Toner Adhered Like Film to Roller: Developing Density Lowered | None |
| −550 V | −250 V | Fused Toner Adhered Like Film to Roller: Developing Density Lowered | None |
| −500 V | −200 V | Fused Toner Being Slightly Adhered Like Film to Roller: Developing Density Not Lowered | None |
| −450 V | −150 V | Fused Toner Being Slightly Adhered Like Film to Roller: Developing Density Not Lowered | None |
| −400 V | −100 V | None | None |
| −370 V | −70 V | None | None |
| −350 V | −50 V | None | None |
| −330 V | −30 V | None | None |
| −320 V | −20 V | None | None |
| −310 V | −10 V | None | Toner Electrostatically Adhered to Blade |
| −300 V | 0 V | None | Toner Electrostatically Adhered to Blade |

As apparent from the table, when the voltage difference is more than $-350$ volts, not only the toner particles but also the developing roller are fused due to the discharge between the blade member and the developing roller, so that recesses are formed in the surface thereof. When the voltage difference is between $-300$ and $-250$ volts, the formation of the recesses can be prevented at the surface of the developing roller, but the fused toner particles are adhered like a film to the surface thereof so that the toner density of the development is lowered. When the voltage difference is between $-200$ and $-150$ volts, the fused toner particles is slightly adhered like a film to the surface of the developing roller, but the toner density of the development is not substantially affected thereby. When the voltage difference is less than $-10$ volts, the toner particles are electrostatically adhered to the blade member. Accordingly, when the polyurethane foam rubber developing roller, the aluminum blade member, and the polyester resin based toner particles are used, the voltage difference should be from $-20$ to $-200$ volts, preferably from $-20$ to $-100$ volts.

Although the embodiments of the present invention are explained in relation to a photosensitive drum, they can be also applied to a dielectric drum on which the electrostatic latent image can be formed. Further, although the developing device according to the present invention is used for the non-magnetic type one-component developer, the magnetic type one-component developer may be also used, if necessary.

Finally, it will be understood by those skilled in the art that the foregoing description is of preferred embodiments of the present invention, and that various changes and modifications can be made thereto without departing from the spirit and scope thereof.

We claim:

1. A developing device using a one-component developer, comprising:

a vessel for holding a one-component developer composed of toner particles;

a developing roller rotatably provided within said vessel in such a manner that a portion of said developing roller is exposed therefrom and faces a surface of an electrostatic latent image carrying body;

said developing roller being formed of a conductive rubber material by which the toner particles are entrained to form a developer layer therearound and are carried to the surface of said electrostatic latent image carrying body for development of an electrostatic latent image formed thereon;

a toner-removing roller rotatably provided within said vessel to be in contact with said developing roller for mechanically removing remaining toner particles not used for the development of the electrostatic latent image from said developing roller;

said toner-removing roller being formed of a conductive open-cell foam rubber material so that pore openings appear over a surface of said toner-removing roller, and that a bias voltage is applied thereto to electrostatically remove said remaining toner particles from said developing roller; and said pore openings having a diameter which is less than twice an average diameter of 10 μm of the toner particles, whereby a penetration of the toner particles into said toner-removing roller is prevented.

2. A developing device as set forth in claim 1, wherein said developing roller being formed of a conductive open-cell foam rubber material so that pore openings appear over a surface of said developing roller, said pore openings of said developing roller having a diameter which is at most twice the average diameter of the toner particles, so that the toner particles are captured and held by said pore openings of said developing roller.

3. A developing device as set forth in claim 2, wherein said conductive open-cell foam rubber material of which said developing roller is formed is selected from a group consisting of a conductive open-cell foam polyurethane rubber material, a conductive open-cell foam silicone rubber material, and a conductive open cell foam acrylonitorile-butadiene rubber material.

4. A developing device as set forth in claim 2, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

5. A developing device as set forth in claim 2, further comprising a developer layer regulating means provided within said vessel and resiliently engaged with said developing roller for regulating a thickness of the developer layer formed around said developing roller, said developing roller having an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

6. A developing device as set forth in claim 2, wherein said conductive open-cell foam rubber material of which said developing roller is formed is a conductive open-cell foam polyurethane rubber material, whereby a resolution of a developed image can be maintained at a high level and over a long period.

7. A developing device as set forth in claim 2, wherein said conductive open-cell foam rubber material of which said developing roller is formed is a conductive open-cell foam polyurethane rubber material which is neutral with regard to frictional electrification, whereby the toner particles can be given a desired charge distribution by utilizing a triboelectrification between said developing roller and the toner particles.

8. A developing device as set forth in claim 2, further comprising a developer layer regulating means provided within said vessel and resiliently engaged with said developing roller for regulating a thickness of the developer layer formed around said developing roller, wherein said developing roller is constituted so that a work function thereof approximates, preferably conforms with, that of the toner particles, to avoid a triboelectrification therebetween, and the toner particles are charged by a triboelectrification between said developer layer regulating means and the toner particles, whereby the toner particles can be given a desired charge distribution regardless of variations of temperature and air moisture content.

9. A developing device as set forth in claim 8, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

10. A developing device as set forth in claim 8, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

11. A developing device as set forth in claim 8, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

12. A developing device as set forth in claim 8, wherein said conductive open-cell foam rubber material of which said developing roller is formed is a conductive open-cell foam polyurethane rubber material, whereby a resolution of a developed image can be maintained at a high levvel and over a long period.

13. A developing device as set forth in claim 2, further comprising a developer layer regulating means provided within said vessel and resiliently engaged with said developing roller for regulating a thickness of the developer layer formed around said developing roller, wherein when the toner particles are charged by a triboelectrification between said developing roller and developer layer regulating means and the toner particles, said developing roller and developer layer regulating means are constituted in such a manner that a relationship of work functions W1 and W2 thereof and a work function W3 of the toner particles is defined by a formula:

$$(W1-W3)\times(W2-W3)>0$$

whereby the toner particles can be given a desired distribution.

14. A developing device as set forth in claim 13, wherein said conductive open-cell foam rubber material of which said developing roller is formed is selected from a group consisting of a conductive open-cell foam polyurethane rubber material, a conductive open cell foam silicone rubber material, and a conductive open-cell foam acrylonitorile-butadiene rubber material.

15. A developing device as set forth in claim 13, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

16. A developing device as set forth in claim 13, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

17. A developing device as set forth in claim 13, wherein said conductive open-cell foam rubber material of which said developing roller is formed is a conductive open-cell foam polyurethane rubber material, whereby a resolution of a developed image can be maintained at a high level and over a long period.

18. A developing device as set forth in claim 2, further comprising a developer layer regulating means provided within said vessel and resiliently engaged with said developing roller for regulating a thickness of the developer layer formed around said developing roller, wherein said developer layer regulating means is formed of a conductive material for applying a bias voltage thereto to prevent the toner particles from being electrostatically adhered to said developer layer regulating means; said developing roller and said developer layer regulating means are constituted in such a manner that work functions thereof approximate, preferably conform with, that of the toner particles to avoid a triboelectrification therebetween; and the toner particles are charged by a charge injection effect resulting from application of the bias voltage to said developer layer regulating means, whereby the toner particles can be given a desired charge distribution regardless of variations of temperature and air moisture content.

19. A developing device as set forth in claim 18, wherein said conductive open-cell foam rubber material of which said developing roller is formed is selected from a group consisting of a conductive open-cell foam polyurethane rubber material, a conductive open cell foam silicone rubber material, and a conductive open-cell foam acrylonitorile-butadiene rubber material.

20. A developing device as set forth in claim 18, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

21. A developing device as set forth in claim 18, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

22. A developing device as set forth in claim 18, wherein said conductive open-cell foam rubber material of which said developing roller is formed is a conductive open-cell foam polyurethane rubber material, whereby a resolution of a developed image can be maintained at a high level and over a long period.

23. A developing device as set forth in claim 2, further comprising a developer layer regulating means provided within said vessel and resiliently engaged with said developing roller for regulating a thickness of the developer layer formed around said developing roller, wherein said developer layer regulating means is formed of a conductive material for applying a bias voltage thereto to prevent the toner particles from being electrostatically adhered to said developer layer regulating means; and a charge-injection effect resulting from application of the bias voltage to said developer layer regulating means and a triboelectrification between said developing roller and/or developer layer regulating means and the toner particles are utilized for charging the toner particles.

24. A developing device as set forth in claim 23, wherein said conductive open-cell foam rubber material of which said developing roller is formed is selected from a group consisting of a conductive open-cell foam polyurethane rubber material, a conductive open cell foam silicone rubber material, and a conductive open-cell foam acrylonitorile-butadiene rubber material.

25. A developing device as set forth in claim 23, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

26. A developing device as set forth in claim 23, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

27. A developing device as set forth in claim 23, wherein said conductive open-cell foam rubber material of which said developing roller is formed is a conductive open-cell foam polyurethane rubber material, whereby a resolution of a developed image can be maintained at a high level and over a long period.

28. A developing device as set forth in claim 2, further comprising a developer layer regulating means provided within said vessel and resiliently engaged with said developing roller for regulating a thickness of the developer layer formed around said developing roller, wherein said developer layer regulating means is formed of a conductive material for applying a bias voltage thereto to prevent the toner particles from being electrostatically adhered to said developer layer regulating means; and when a charge-injection effect resulting from application of the bias voltage to said developer layer regulating means is utilized for charging the toner particles, a difference between the bias voltage applied to said developer layer regulating means and a developing bias voltage applied to said developing roller is less than a level at which a high electrical current or an electrical discharge occurs between said developer layer regulating means and said developing roller.

29. A developing device as set forth in claim 28, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

30. A developing device as set forth in claim 28, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

31. A developing device as set forth in claim 28, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

32. A developing device as set forth in claim 28, wherein said conductive open-cell foam rubber material of which said developing roller is formed is a conductive open-cell foam polyurethane rubber material, whereby a resolution of a developed image can be maintained at a high level and over a long period.

33. A developing device using a one-component developer, comprising:

a vessel for holding a one-component developer composed of toner particles;

a developing roller rotatably provided within said vessel in such a manner that a portion of said developing roller is exposed therefrom and faces a surface of an electrostatic latent image carrying body;

said developing roller being formed of a conductive rubber material having pore openings along its outer peripheral surface by which the toner particles are entrained to form a developer layer therearound and are carried to the surface of said electrostatic latent image carrying body for development of an electrostatic latent image formed thereon;

a toner-removing roller rotatably provided within said vessel to be in contact with said developing roller for mechanically removing remaining toner particles not used for the development of the electrostatic latent image from said developing roller;

said toner-removing roller being formed of a conductive open-cell foam rubber material so that pore openings appear over a surface of said toner-removing roller, and that a bias voltage is applied thereto to electrostatically feed the toner particles to the developing roller; and said pore openings of said toner-removing roller having a diameter which is less than twice an average diameter of the toner particles, whereby a penetration of the toner particles into said toner-removing roller is prevented.

34. A developing device as set forth in claim 33, wherein said developing roller being formed of a conductive open-cell foam rubber material so that said pore openings of said developing roller appear over a surface of said developing roller, said pore openings of said developing roller having a diameter which is at most twice the average diameter of the toner particles, so that the toner particles are captured and held by said pore openings of said developing roller.

35. A developing device as set forth in claim 34, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

36. A developing device as set forth in claim 34, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

37. A developing device as set forth in claim 34, further comprising a developer layer regulating means provided within said vessel and resiliently engaged with said developing roller for regulating a thickness of the developer layer formed around said developing roller, said developing roller having an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

38. A developing device as set forth in claim 37, wherein said conductive open-cell foam rubber material of which said developing roller is formed is a conductive open-cell foam polyurethane rubber material, whereby a resolution of a developed image can be maintained at a high level and over a long period.

39. A developing device as set forth in claim 37, wherein said conductive open-cell foam rubber material of which said developing roller is formed is a conductive open-cell foam polyurethane rubber material which is neutral with regard to frictional electrification, whereby the toner particles can be given a desired charge distribution by utilizing a triboelectrification between said developing roller and the toner particles.

40. A developing device as set forth in claim 34, further comprising a developer layer regulating means provided within said vessel and resiliently engaged with said developing roller for regulating a thickness of the developer layer formed around said developing roller, wherein said developing roller is constituted so that a work function thereof approximates, preferably conforms with, that of the toner particles, to avoid a triboelectrification therebetween, and the toner particles are charged by a triboelectrification between said developer layer regulating means and the toner particles, whereby the toner particles can be given a desired charge distribution regardless of variations of temperature and air moisture content.

41. A developing device as set forth in claim 40, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

42. A developing device as set forth in claim 40, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

43. A developing device as set forth in claim 40, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

44. A developing device as set forth in claim 40, wherein said conductive open-cell foam rubber material of which said developing roller is formed is a conductive open-cell foam polyurethane rubber material, whereby a resolution of a developed image can be maintained at a high level and over a long period.

45. A developing device as set forth in claim 34, further comprising a developer layer regulating means provided within said vessel and resiliently engaged with said developing roller for regulating a thickness of the developer layer formed around said developing roller, wherein when the toner particles are charged by a triboelectrification between said developing roller and developer layer regulating means and the toner particles, said developing roller and developer layer regulating means are constituted in such a manner that a relationship of work functions W1 and W2 thereof and a work function W3 of the toner particles is defined by a formula:

$$[(W1-W3)](W1-W3)\times[(W2-W3)](W2-W3)>0$$

whereby the toner particles can be given a desired distribution.

46. A developing device as set forth in claim 45, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

47. A developing device as set forth in claim 45, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

48. A developing device as set forth in claim 45, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

49. A developing device as set forth in claim 45, wherein said conductive open-cell foam rubber material of which said developing roller is formed is a conductive open-cell foam polyurethane rubber material, whereby a resolution of a developed image can be maintained at a high level and over a long period.

50. A developing device as set forth in claim 34, further comprising a developer layer regulating means provided within said vessel and resiliently engaged with said developing roller for regulating a thickness of the developer layer formed around said developing roller, wherein said developer layer regulating means is formed of a conductive material for applying a bias voltage thereto to prevent the toner particles from being electrostatically adhered to said developer layer regulating means; said developing roller and said developer layer regulating means are constituted in such a manner that work functions thereof approximate, preferably conform with, that of the toner particles to avoid a triboelectrification therebetween; and the toner particles are charged by a charge-injection effect resulting from application of the bias voltage to said developer layer regulating means, whereby the toner particles can be given a desired charge distribution regardless of variations of temperature and air moisture content.

51. A developing device as set forth in claim 50, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

52. A developing device as set forth in claim 50, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

53. A developing device as set forth in claim 50, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

54. A developing device as set forth in claim 50, wherein said conductive open-cell foam rubber material of which said developing roller is formed is a conductive open-cell foam polyurethane rubber material, whereby a resolution of a developed image can be maintained at a high level and over a long period.

55. A developing device as set forth in claim 34, further comprising a developer layer regulating means provided within said vessel and resiliently engaged with said developing roller for regulating a thickness of the developer layer formed around said developing roller, wherein said developer layer regulating means is formed of a conductive material for applying a bias voltage thereto to prevent the toner particles from being electrostatically adhered to said developer layer regulating means; and a charge-injection effect resulting from application of the bias voltage to said developer layer regulating means and a triboelectrification between said developing roller and/or developer layer regulating means and the toner particles are utilized for charging the toner particles.

56. A developing device as set forth in claim 55, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

57. A developing device as set forth in claim 55, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

58. A developing device as set forth in claim 55, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

59. A developing device as set forth in claim 55, wherein said conductive open-cell foam rubber material of which said developing roller is formed is a conductive open-cell foam polyurethane rubber material, whereby a resolution of a developed image can be maintained at a high level and over a long period.

60. A developing device as set forth in claim 34, further comprising a developer layer regulating means provided within said vessel and resiliently engaged with said developing roller for regulating a thickness of the developer layer formed around said developing roller, wherein said developer layer regulating means is formed of a conductive material for applying a bias voltage thereto to prevent the toner particles from being electrostatically adhered to said developer layer regulating means; and when a charge-injection effect resulting from application of the bias voltage to said developer layer regulating means is utilized for charging the toner particles, a difference between the bias voltage applied to said developer layer regulating means and a developing bias voltage applied to said developing roller is less than a level at which a high electrical current or an electrical discharge occurs between said developer layer regulating means and said developing roller.

61. A developing device as set forth in claim 60, wherein said conductive open-cell foam rubber material of which said developing roller is formed is selected from a group consisting of a conductive open-cell foam polyurethane rubber material, a conductive open-cell foam silicone rubber material, and a conductive open-cell foam acrylonitorile-butadiene rubber material.

62. A developing device as set forth in claim 60, wherein said developing roller is resiliently pressed against the surface of said electrostatic latent image carrying body, and has an Asker C-hardness of at most 50°, preferably 35°, whereby an operating life of said electrostatic latent image carrying body can be prolonged.

63. A developing device as set forth in claim 60, wherein said developing roller has an Asker C-hardness of at most 50°, preferably 35°, and said developer layer regulating means is formed of a metal material selected from a group consisting of aluminum, stainless steel, and brass, whereby variations of the developer layer thickness regulated by said developer layer regulating means can be reduced.

64. A developing device as set forth in claim 60, wherein said conductive open-cell foam rubber material of which said developing roller is formed is a conductive open-cell foam polyurethane rubber material, whereby a resolution of a developed image can be maintained at a high level and over a long period.

* * * * *